US007171148B2

(12) United States Patent
Mitsuoka et al.

(10) Patent No.: US 7,171,148 B2
(45) Date of Patent: Jan. 30, 2007

(54) FIXING DEVICE, IMAGE FORMING DEVICE, AND MANUFACTURING METHOD OF FIXING DEVICE

(75) Inventors: Tetsunori Mitsuoka, Habikino (JP); Hiroshi Kida, Yamatokoriyama (JP); Toshiaki Kagawa, Kitakatsuragi-gun (JP); Takashi Yamanaka, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 253 days.

(21) Appl. No.: 10/997,628

(22) Filed: Nov. 23, 2004

(65) Prior Publication Data

US 2005/0111892 A1 May 26, 2005

(30) Foreign Application Priority Data

Nov. 25, 2003 (JP) ..... 2003-393917

(51) Int. Cl.
*G03G 15/20* (2006.01)

(52) U.S. Cl. ..... 399/328; 219/216

(58) Field of Classification Search ..... 399/67, 399/69, 307, 320, 328, 329, 330, 331, 333; 219/216, 388, 469
See application file for complete search history.

(56) References Cited

U.S. PATENT DOCUMENTS 4,438,321 A * 3/1984 Moraw ..... 219/216
6,144,833 A * 11/2000 Ito et al. ..... 399/328
6,304,741 B1 * 10/2001 Tange ..... 399/328
6,580,896 B2 * 6/2003 Lee ..... 399/330

FOREIGN PATENT DOCUMENTS

| | | |
|---|---|---|
| JP | 06-003995 | 1/1994 |
| JP | 10-069178 | 3/1998 |
| JP | 2001343851 A * | 12/2001 |
| JP | 2003-167463 | 6/2003 |

* cited by examiner

*Primary Examiner*—Robert Beatty
(74) *Attorney, Agent, or Firm*—George W. Neuner; David G. Conlin; Edwards Angell Palmer & Dodge LLP

(57) ABSTRACT

A fixing device comprising a fix member for touching an unfixed image on a recording medium, and a press member for being pressed against the fixing member, so as to fix the unfixed image on the recording medium by transporting the recording medium through a nip between the fix member and the press member, wherein $(100 \cdot K1) \leqq (K2) \leqq (320 \cdot K1)$ where K1 is a heat transmission coefficient of the press member and K2 is a heat transmission coefficient of the fix member. With this arrangement, it is possible to transmit heat to toner and the recording medium in a short time. Thus, it is possible to attain high-speed printing.

25 Claims, 18 Drawing Sheets

FIG. 6

| | | MATERIAL | THICKNESS mm | HEAT CONDUCTIVITY W/m·K | SPECIFIC HEAT J/Kg°C | DENSITY Kg/m3 | HEAT RESISTANCE m2·K/W | COEFFICIENT OF OVERALL HEAT TRANSMISSION W/m2·K |
|---|---|---|---|---|---|---|---|---|
| FIX ROLLER | RELEASING LAYER | PFA/PTFE | 0.025 | 0.1587 | 1046 | 2140 | 0.00015753 | 5364 |
| | CORE | STKM13A | 1.3 | 45 | 460 | 7800 | 0.00002889 | |

| | | MATERIAL | THICKNESS mm | HEAT CONDUCTIVITY W/m·K | SPECIFIC HEAT J/Kg°C | DENSITY Kg/m3 | HEAT RESISTANCE m2·K/W | COEFFICIENT OF OVERALL HEAT TRANSMISSION W/m2·K |
|---|---|---|---|---|---|---|---|---|
| PRESS ROLLER | RELEASING LAYER | PFA | 0.05 | 0.1587 | 1046 | 2140 | 0.00031506 | 33.6 |
| | ELASTIC LAYER | LOW HEAT CAPACITY Si RUBBER | 5 | 0.17 | 1340 | 820 | 0.02941176 | |
| | CORE | STKM13A | 3 | 45 | 460 | 7800 | 0.00006667 | |

| | W.U.T. (SECOND) | POWER CONSUMPTION (Wh) | |
|---|---|---|---|
| | | During WUP PERIOD | During SHEET PASSING PERIOD |
| PRESENT EMBODIMENT | 85.7 | 26.1 | 281.8 |
| COMPARATIVE EXAMPLE | 211.0 | 64.4 | 313.1 |

FIG. 12

| | | MATERIAL | THICKNESS mm | HEAT CONDUCTIVITY W/m·K | SPECIFIC HEAT J/Kg°C | DENSITY Kg/m3 | HEAT RESISTANCE m2·K/W | COEFFICIENT OF OVERALL HEAT TRANSMISSION W/m2·K |
|---|---|---|---|---|---|---|---|---|
| FIX ROLLER | RELEASING LAYER | PFA/PTFE | 0.025 | 0.1587 | 1046 | 2140 | 0.00015753 | 6009 |
| | CORE | STKM13A | 0.4 | 45 | 460 | 7800 | 0.00000889 | |

| | | MATERIAL | THICKNESS mm | HEAT CONDUCTIVITY W/m·K | SPECIFIC HEAT J/Kg°C | DENSITY Kg/m3 | HEAT RESISTANCE m2·K/W | COEFFICIENT OF OVERALL HEAT TRANSMISSION W/m2·K |
|---|---|---|---|---|---|---|---|---|
| PRESS ROLLER | RELEASING LAYER | PFA | 0.05 | 0.1587 | 1046 | 2140 | 0.00031506 | 33.6 |
| | ELASTIC LAYER | LOW HEAT CAPACITY Si RUBBER | 5 | 0.17 | 1340 | 820 | 0.02941176 | |
| | CORE | STKM13A | 3 | 45 | 460 | 7800 | 0.00006667 | |

FIG. 14

| THICKNESS (mm) | W.U.T. (SECOND) | | POWER CONSUMPTION DURING WUP PERIOD (Wh) | | POWER CONSUMPTION DURING SHEET PASSING PERIOD (Wh) | |
|---|---|---|---|---|---|---|
| | PRESENT EMBODIMENT | COMPARATIVE EXAMPLE B | PRESENT EMBODIMENT | COMPARATIVE EXAMPLE B | PRESENT EMBODIMENT | COMPARATIVE EXAMPLE B |
| 1 | 61.9 | 81.3 | 19.0 | 24.7 | 277.0 | 281.4 |
| 3 | 46.5 | 58.6 | 14.3 | 18.0 | 273.7 | 276.5 |
| 5 | 45.5 | 56.8 | 14.0 | 17.5 | 274.3 | 277.6 |
| 8 | 43.5 | 54.1 | 13.5 | 16.5 | 274.5 | 278.3 |

FIG. 16

| | HEAT CONDUCTIVITY | EQUIVALENT THICKNESS |
|---|---|---|
| | W/m·K | mm |
| COMPARATIVE EXAMPLE A | 0.12 | 240 |
| PRESENT EMBODIMENT | 0.17 | 340 |
| COMPARATIVE EXAMPLE B | 0.27 | 540 |
| COMPARATIVE EXAMPLE C | 0.45 | 900 |

HEAT RECEIVING SURFACE
(SURFACE ON WHICH ROLLER CONTACTS)

FIXING DEVICE, IMAGE FORMING DEVICE, AND MANUFACTURING METHOD OF FIXING DEVICE

This Nonprovisional application claims priority under 35 U.S.C. § 119(a) on Patent Application No. 2003-393917 filed in Japan on Nov. 25, 2003, the entire contents of which are hereby incorporated by reference.

FIELD OF THE INVENTION

The present invention relates to fixing devices in, among others: electrophotographic image forming devices in copying machines and printers; drier devices in electrophotographic devices of wet types; drier devices in inkjet printers; and rewriteable medium eraser devices.

BACKGROUND OF THE INVENTION

In conventional image forming device and like devices, a fixing process is carried out for fixing toner onto a recording material. In the fixing process, a toner image formed with toner or the like on the recording material in an image forming process in an upstream of the fixing process is heated so that the toner is melted and fixed onto the material, while the recording material is being transported between two cylindrical members, namely a fix member and a press member.

The fix member, if thinner than the conventional fix member, may require a longer warm-up time (may have a poor warm-up performance), depending on the balance of the heating and adiabatic performance of the fix and press members between which the recording material is transferred. The extension of warm-up time will reduce convenience. Adverse effects are not limited to the warm-up time extension; the warm-up time extension results in higher power consumption level in standby mode, against the popular trend of energy conservation.

A common approach available to energy loss reduction is to improve the thermal insulation of the whole fixing device. However, if the balance of the heating and thermal insulating (adiabatic) performance of the fix and press members is anything less than desirable, the device consumes more power in the heating of the recording material for the fixing, thereby adversely affecting the overall energy saving performance by the image forming device.

The warm-up performance especially affects power consumption in warm-up and standby, as well as convenience in use. In some cases, regulations were or will be set to set higher standards for the warm-up performance. Further, the power available for the image forming device to perform the heating and fixing of the recording material are so limited. In some cases, the image forming device would be undesirably underpowered depending on various power supply conditions, such as a number of periphery devices added, countries or regions the image forming device is used, etc. It is desired that the image forming device is capable of performing the fixing on less electric power.

In view of the aforementioned problems, Japanese patent 2994858 (registered on Dec. 27, 1999), conventional art, discloses a fixing device in which the fix member has a lowered thermal capacity and the press member is made of silicone sponge. The silicone sponge has fine air bubbles in it for improved thermal insulation. The air bubbles gives the silicone sponge higher heat insulating (adiabatic) property.

The use of silicone sponge press member works well when the press and fix members are under a light load. It however faces structural problems of the silicone sponge press member itself and the fix member, when applied to high speed, heavy load conditions.

For example, to perform high speed printing at a high throughput, the nip needs be wider so that it can provide heat to the toner and recording material quickly. One could readily achieve a wider nip by making the press member from a softer silicone sponge material. This however would make the air bubbles in the silicone sponge easy to collapse, thereby leading to permanent deformation of the silicone sponge, depriving the required level of elasticity from the silicone sponge.

In an arrangement where low temperature fixing is adopted for alleviating the adverse effects of high temperature on the recording material and the toner, the permanent deformation of the silicone sponge, and the resultant loss of elasticity in the silicone sponge would also be caused when the air bubbles in the silicone sponge, as described above, becomes easy to collapse as the result of the application of a heavy load to the fix and press members for high speed printing. The silicone sponge or like elastic body could permanently deformed markedly at near a surface thereof, thereby leading to lower thermal adiabatic performance of the press member. This would result in the nip with too large width, and thus excessive fixing. The excessive fixing leads to inconveniences like high temperature offset and twining. When the permanent deformation of the press member is further progressed, the press member cannot sustains its elasticity by which it can function as it is. Such loss of elasticity shortens life of the press member and the device to which the press member is provided.

As described above, the use of silicone sponge for the press member is associated with the various problems in order to deal with the high speed and heavy load, thus it is difficult to realize high-speed printing by the use of silicone sponge for the press member.

SUMMARY OF THE INVENTION

An object of the present invention is to provide a fixing apparatus capable of realizing high-speed printing by transmitting heat to the toner and the recording medium in a short time.

In order to attain the object, a fixing device according to the present invention includes a fix member for touching an unfixed image on a recording medium and a press member for being pressed against the fixing member, so as to fix the unfixed image on the recording medium by transporting the recording medium through a nip between the fix member and the press member, wherein:

$$(100 \cdot K1) \leqq (K2) \leqq (320 \cdot K1)$$

where K1 is a heat transmission coefficient of the press member and K2 is a heat transmission coefficient of the fix member.

The "heat transmission coefficient" of a material is a parameter that indicates how easily heat flux passes through the material. The larger this parameter, the more easily the heat flux passes through the material. Specifically, the heat transmission coefficient of a material is a reciprocal number of heat transmission resistance of the material. Moreover, the heat transmission resistance of a material can be calculated by (thickness of the material/heat conductivity of the material).

As a result of diligent studies, the inventors of the present invention found out that it is easy to transmit heat to the fix member but it is difficult to transmit, to the press member, the heat thus transmitted to the fix member, thereby efficiently utilizing, for fixing operation, the heat transmitted to the fix member, where in the fixing device the heat transmission coefficient K1 of the press member and the heat transmission coefficient K2 of the fix member satisfy $(100 \cdot K1) \leqq (K2) \leqq (320 \cdot K1)$. With this arrangement, it is possible to transmit the heat from the fixing device to the toner and the recording medium in a short time, thereby realizing the high-speed printing.

For a fuller understanding of the nature and advantages of the invention, reference should be made to the ensuing detailed description taken in conjunction with the accompanying drawings.

BRIEF DESCRIPTION OF THE DRAWINGS

FIG. 6 is a table illustrating parameters of various properties of the fix roller and press roller provided in the fixing device shown in FIG. 1.

FIG. 12 is a front view illustrating an interior structure of an image forming device provided with the fixing device shown in FIG. 10.

FIG. 14 is a table illustrating warm-up time, power consumption during the warm-up time, power consumption during sheet-passing time, of the fixing device shown in FIG. 10 and the comparative fixing devices, in cases of various thickness (layer thickness) of the elastic layer of the press roller.

FIG. 16 is a table illustrating equivalent thickness of the elastic layers of the press rollers in the fixing device shown in FIG. 10 and the comparative fixing device.

DESCRIPTION OF THE EMBODIMENTS

[Structure of Image Forming Device]

An embodiment according to the present invention will be described below, referring to drawings.

Figure 3:
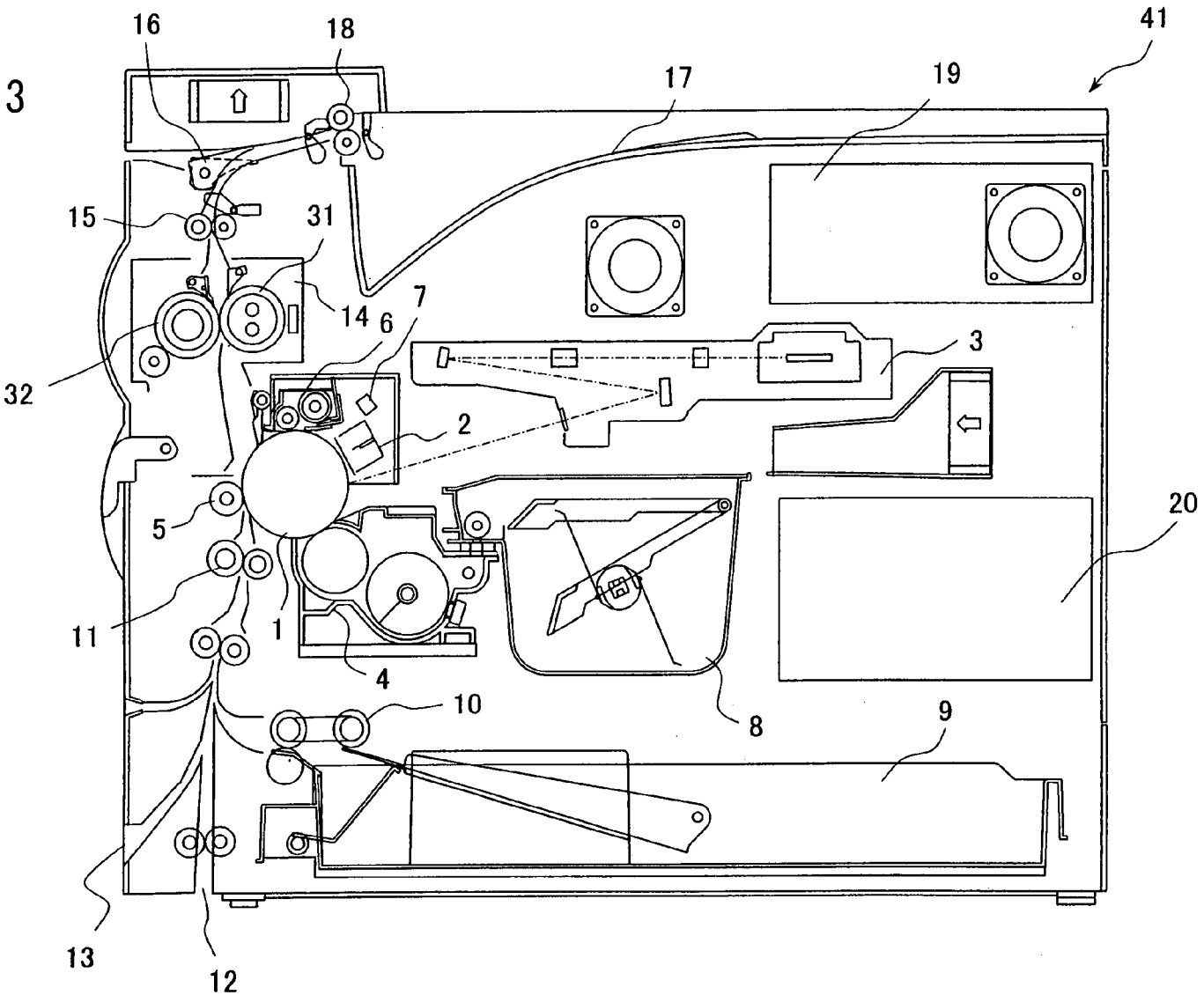
FIG. 3 is a front view illustrating an interior structure of an image forming device provided with the fixing device shown in FIG. 1.

FIG. 3 is a front view illustrating an internal structure of an electrophotographic image forming device (image forming device 41) of the embodiment according to the present invention. The image forming device 41 is configured to read an image read via an image reading device 42 (see FIG. 4), or receive data from an apparatus (an image processing device such as a personal computer or the like) externally connected to the image forming device 41, and then output the thus read image or the thus received data as an image.

In the image forming device 41, process units for performing various steps of image formation are provided around a photosensitive drum 1 located at the center, thereby forming an image forming section. Around the photosensitive drum 1, an electrical charging device 2, an optical scanning device 3, a developing device 4, a transferring device 5, a cleaning device 6, and an electrical discharging device 7, and the like are provided in this order in a rotational direction of the photosensitive drum 1.

The electrical charging device 2 is configured to charge (electrify) a surface of the photosensitive drum 1 evenly. The optical scanning device 3 is configured to write an electrostatic latent image by forming an optical image on the photosensitive drum 1 by optical scanning. The developing device 4 is configured to form a toner image from the electrostatic latent image (that is, visualize the electrostatic latent image) with a developer supplied from a developer supplying container 8, the electrostatic latent image written by the optical scanning device 3. The transferring device 5 is configured to transfer, onto a recording medium, the image thus visualized on the photosensitive drum 1. The cleaning device 6 is configured to remove developer left over on the photosensitive drum 1, thereby providing for forming a new image on the photosensitive drum 1. The electrical discharging device 7 is configured to electrically discharge (remove charges from) the surface of the photosensitive drum 1.

In a lower part of the image forming device 41, a supplying tray 9 is internally provided. The supplying tray 9 is a recording medium containing tray for containing the recording medium therein. The recording medium contained in the supplying tray 9 is separated, sheet by sheet, by a pick-up roller 10 or the like, and then transferred to resist rollers 11. The recording medium transferred to the resist rollers 11 is sequentially supplied to a nip between the transferring device 5 and the photosensitive drum 1, in a timing to meet with the image formed on the photosensitive drum 1. The resist rollers 11 take the timing for the recording medium. Then, the image reproduced on the photosensitive drum 1 is transferred on the recording medium. Note that replenishment of the recording medium to the supplying tray 9 is carried out by pulling the supplying tray 9 out of the image forming device 41 in a front direction (toward an operator).

Figure 4:
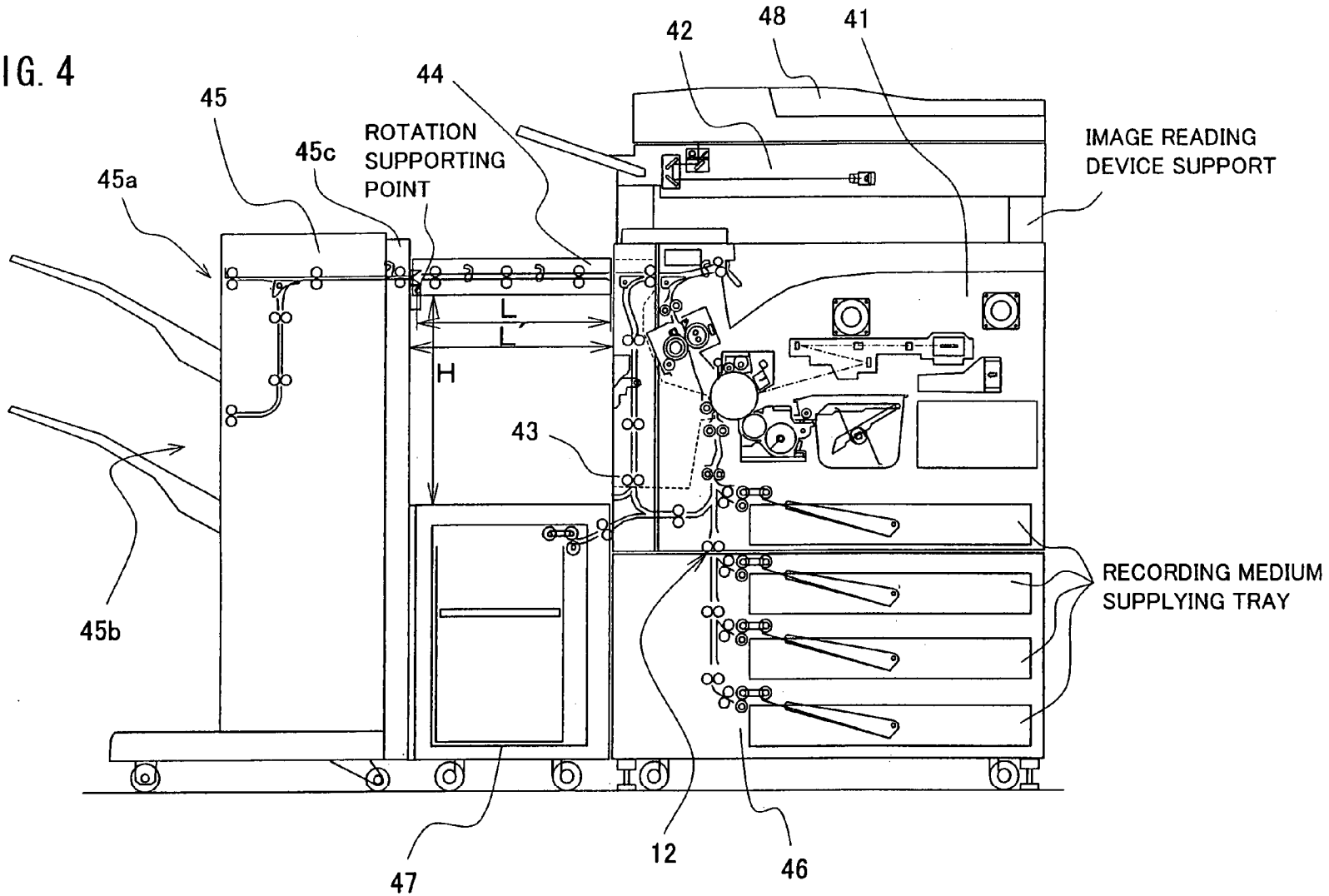
FIG. 4 is a front view illustrating an image forming system including the image forming device shown in FIG. 3.

The image forming device 41 is provided with recording medium inlets 12 and 13, which are located on surfaces of lower portion of the image forming device 41. As illustrated in FIG. 4, the recording medium inlets 12 and 13 are configured to receive the recording medium transported from recording medium supplying devices 46, a recording medium supplying device 47, or the like devices attached to the image forming device 41 as peripheral devices, and then to sequentially supply the recording medium to the image forming section. The recording medium supplying devices 46 are recording medium supplying devices having a plurality of recording supplying trays, whereas the recording medium supplying device 47 is a recording medium supplying device having a large capacity of storing a large amount of recording medium.

In an upper part of the interior of the image forming device 41, a fixing device 14 is provided. The fixing device 14 is configured to sequentially receive the recording medium on which the image is transferred, and to fix the transferred image on the recording medium by application of heat and pressure. The heat and pressure are applied by a fix roller 31 and a press roller 32, which respectively function as a fix member and a press member. In this way, the image is recorded (formed) on the recording medium.

The recording medium on which the image has been recorded is transferred upward by a transport roller 15, and passes by a switching gate 16. If the switching gate 16 is so switched to lead the recording medium to an output tray 17 externally attached to the image forming device 41, the recording medium is delivered out into the output tray 17 by reversing rollers 18.

On the other hand, in case where the recording medium is to be subjected to both-side image formation or post-treatment, the recording medium is transported, by the reversing roller 18, in the direction of the output tray 17 (in a forward direction), but to be kept held between the reversing rollers 18 so that the recoding medium is not completely delivered out. Then the recording medium is transported in a backward direction by the reversing rollers 18 that is now rotated reversely. The recording medium thus transported backward is transported for a recording medium resupplying transporting device 43 (see FIG. 4), a post-treatment 45 (see FIG. 4). In the backward transport of the recording medium, the switching gate 16 is switched to the state illustrated by the broken line in FIG. 3 from the state illustrated by the solid line in FIG. 3.

In the case of the both-side image formation, the recording medium thus transported backward is again supplied to the image forming device 41 through the recording medium resupplying transport device 43. In the case of the post-treatment, the recording medium thus transported backward is transported to the post-treatment device 45 via a relay transport device 44 from the recording medium resupplying transport device 43 by using another switching gate.

In a space above the optical scanning device 3, a control device 19 is provided, which contains a circuit substrate, an interface substrate, or the like. The circuit substrate controls the image forming process. The interface substrate receives the image data from external apparatus. Moreover, in a space under the optical scanning device 3, a power supply device 20 or the like is provided. The power supply device 20 supplies power to the various interface substrate, and image forming process units.

The image forming device 41 shown in FIG. 3 is provided in an image forming system shown in FIG. 4. The image forming system is provided with the image reading device 42, the recording medium resupplying transport device 43, the relay transport device 44, the post-treatment device 45, the recording medium supplying device 46, and the recording medium supplying device 47, as well as the image forming device 41.

By radiating light onto a document that is set thereon, the image reading device 42 optically scans the document, thereby obtaining an image of the document on a CCD (charge coupled device), which is an photo-electric converting element. After converting the image of the document into an electric signal by the CCD, the image reading device 42 outputs the electric signal as the image data. The image data thus read is written onto the photosensitive drum 1 by the optical scanning device 3 after subjected to treatment such as image correction, rasterising, etc. by an image processing means of the image forming device 41.

The image reading device 42 is able to read not only one side of the document but also another side of the document almost concurrently. Moreover, it is possible to supply the document to the image reading device 42 automatically (by using an automatic document transport device 48) or manually.

The recording medium resupplying transport device 43 is a recording medium transport path unit attached to a left-side portion of the image forming device 41. The recording medium resupplying transport device 43 supplies, again to an image transferring section of the image forming device 41, the recording medium thus transported to the recording medium resupplying transport device 43 after the recording medium is delivered out from the fixing device 14 (that is, the image is recorded on the recording medium) and then reversed by using the reversing roller 18, the image transferring section is located between (a) the photosensitive drum 1 and transferring device 5, and (b) the post-treatment device 45.

The relay transport device 44 is configured to transport the recording medium to the post-treatment device 45, and is provided between the recording medium resupplying transport device 43 and the post-treatment device 45.

The post-treatment device 45 is located in the left portion of the image forming system, and is provided with a first recording medium output section 45*a* and the second recording medium output section 45*b*.

The recording medium is received by a reception transport section 45*c* after outputted from the image forming device 41 (that is, the recording medium on which the image has been formed). The reception transport section 45*c* is located in an upper portion of the side surface of the post-treatment device 45. The first recording medium output section 45*a* is configured to output the thus received recording medium as it is. The second recoding medium output section 45*b* is configured to output the thus received recording medium after subjected to the post-treatment by the post-treatment device 45 that is selectively attached thereto, and may be a stapler, a punching device, or the like device. The first and second recording medium output sections 45*a* and 45*b* are selected by a user at his will.

Even though it is not shown, the post-treatment device 45 is provided with some or all of the following functions in combination: stapling the recording medium every predetermined number of sheets; folding the recording medium of B4 or A3 size; punching out a filing hole; and sorting out the recording medium into several to several ten bins.

The characteristics of the present invention especially pertains to the fixing device 14. In the following first to fourth embodiments, the fixing device 14 will be described in detail.

[First Embodiment]

Figure 1:
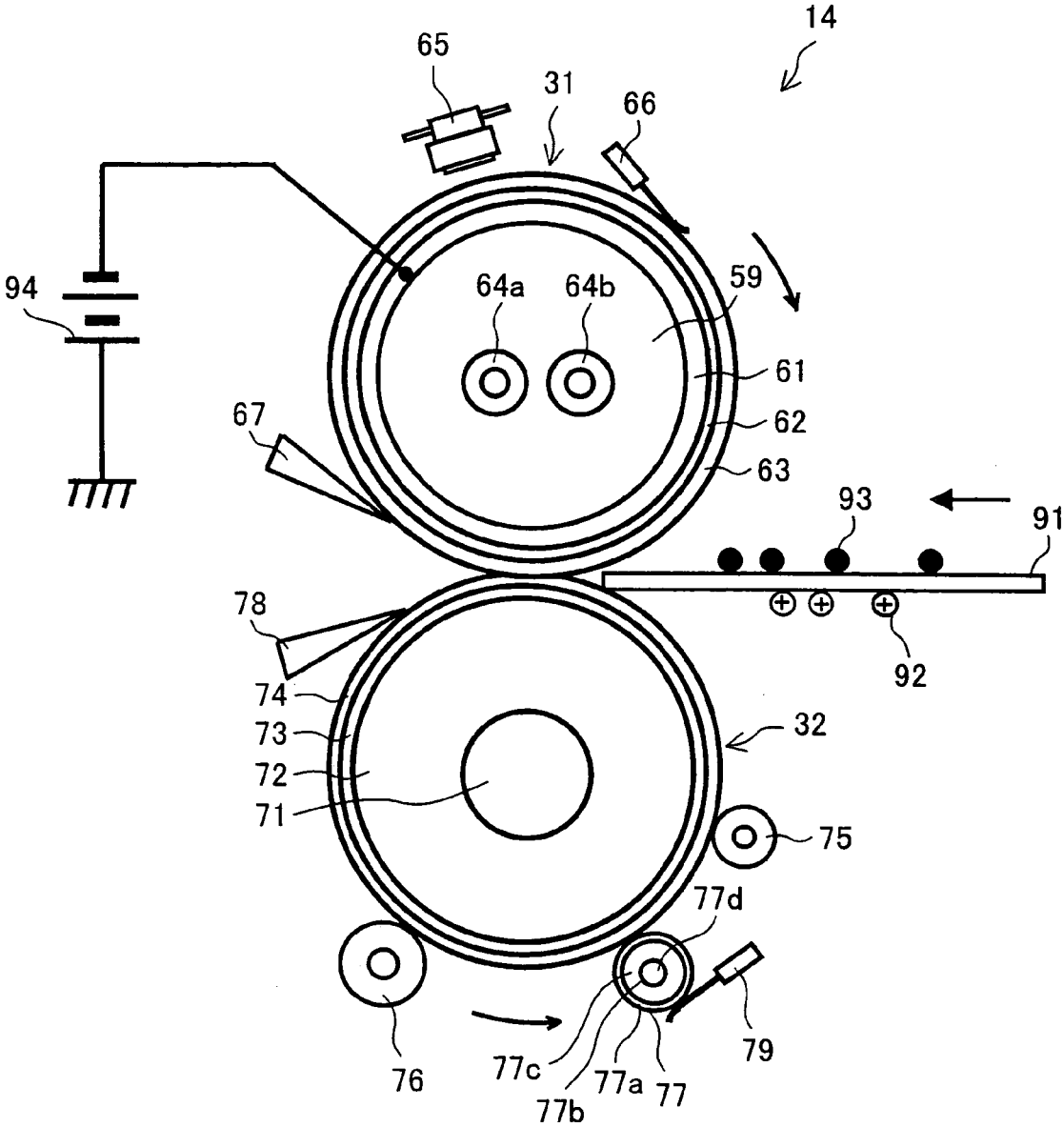
FIG. 1 is a vertical cross sectional view illustrating a fixing device according to an embodiment of the present invention.

Referring to FIG. 1, an example of an arrangement of a fixing device of an image forming device according to the first embodiment will be described below.

FIG. 1 illustrates details of a structure of the fixing device 14. FIG. 1 is a vertical cross sectional view illustrating the fixing device 14. In the fixing device 14, a fix roller 31, which is a fix member in a roller form, is internally provided with a core 61 that is conductive (and may be a metal core), whereas a press roller 32, which is a press member, is internally provided with a core 71 that is conductive (and may be a metal core).

The fix roller 31 is formed with the core 61 as a base member, and is 40 mm in external diameter and 1.3 mm in thickness (thickness of a layer without the core). The core 61 is formed to have a predetermined external diameter and thickness by subjecting an iron-type cold rolled carbon steel tube to drawing process or the like, and then polishing the thus prepared tube. The fix roller 31 is provided with the core 61 in a cylinder tube-like shape, a releasing layer 63 formed, in a cylinder tube-like shape, on/above an outer surface of the core 61, and an intermediate layer 62 bonded with the core 61 and the releasing layer 63.

Figure 2:
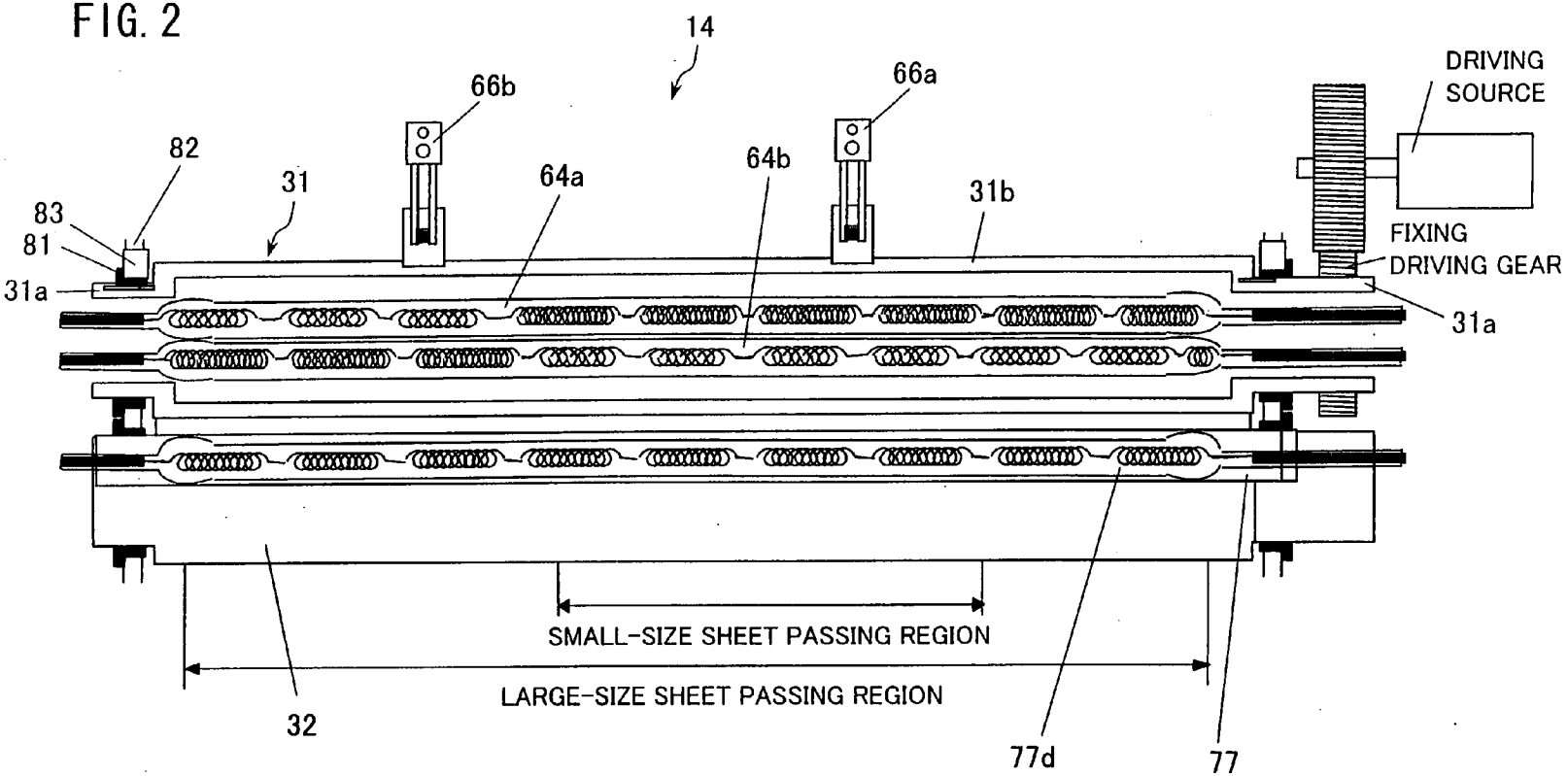
FIG. 2 is a front view illustrating a supporting structure for a fix roller and press roller shown in FIG. 1.

The fix roller 31 is narrowed at its ends 31 (see FIG. 2). The ends 31 is 30 mm in external diameter and 1.5 mm in thickness. Load applied on the fix roller 31 is sustained by ball bearings 81 (see FIGS. 2 and 5), which are bearing support members. Note that the ball bearings 81 are a kind of antifriction bearings.

A surface of the core 61 of the fix roller 31 has been subjected to Parkerizing treatment (phosphate coating treatment) for rust proofing. In this way, the core 61 is rust proofed. Note that the thickness and material of core may be arbitrarily varied depending on load application condition of the fixing device, the arrangement of the roller, process speed, durability requirement, and the like conditions.

A shaft sleeve section 31*b* (see FIG. 2) of the fix roller 31 is a middle portion without being narrowed. The shaft sleeve section 31*b* is generally made of a fluorine-type resin that can keep its releasing performance even when contacted with toner thermally melted. The fluorine-type resin is coated, as a releasing layer (surface electric insulating layer) 63, on the core 61 that is conductive. The intermediate layer 62 is provided between the core 61 and the releasing layer 63. Note that, in the present embodiment, the fluorine-type resin of the releasing layer 63 is a mixture of PEF (a copolymer of tetrafluoroethylene and perfluoroalkylvinylether) and PTFE (polytetrafluoroethylene). In the mixture, mica or reinforcing filler is dispersed as a reinforcing material. The mixture is prepared by baking after coating, thereby being formed into the releasing layer 63. Note that the releasing layer 63 may be made of PFA or PTFE solely, which may contains the mica or the reinforcing filler dispersedly.

The releasing layer 63 may be made of other types of materials solely or in combination, for the sake of heat resistivity and releasing property. The other types of materials may be, for example: fluoride-type resins such as FEP (copolymer of tetrafluoroethylene and hexafluoropropylene), ETFE (copolymer of ethylene and tetrafluoroethylene, PCTFE (polychlorotrifluoroethylene), ECTFE (copolymer of ethylene and chlorotrifluoroethylene), PVDF (polyvinylidene fluoride), and the like; and materials containing fluoride rubber latex; and the like. These materials may be formed by coating and subsequent baking, or by tube-coating.

The intermediate layer 62 improves bonding between the fluoride-type resin as the releasing layer 63, and the surface of the core 61, which is a carbon-steel tube. In the present embodiment, the intermediate layer 62 is formed by thinly coating the core 61 with an electric insulating primer, which is an adhesive agent of a rubber-type, a resin-type, or like types. Note that, instead of the electric insulating primer, a conductive primer may be used as the intermediate layer 62.

Moreover, in the fix roller 31, a heat resisting heat absorption layer 59 is provided. When halogen lamps 64*a* and 64*b*, which are heating units internally provided in the fix roller 31, emit energy such as infra red light or the like onto an inter circumferential surface of the fix roller 31, the heat resisting heat absorption layer 59 absorbs the energy and then efficiently converts the energy into heat. The heat resisting heat absorption layer 59 is, for example, made of a mixture of a denatured silicone resin, inorganic heat resisting black pigment, carbohydrate (solvent) and the like, and prepared by coating and then drying. In general, a heat resisting coating material such as Okitsumo (product name), Tetzsol (product name), cellmo L1-900 black 2 (product name), or the like is used as the heat resisting absorption layer 59. In the present embodiment, cellmo L1-900 black 2 is used.

Furthermore, in a downstream (sheet-output side) of the fix roller 31 and the press roller 32, an upper peeling-off member 67 and a lower peeling-off member 78 are provided in order to facilitate peeling-off (removing) of the recording medium from the rollers 31 and 32. The upper peeling member 67 and the lower peeling member 78 are respectively in contact with the rollers 31 and 32, lightly. In this way, the upper peeling member 67 and the lower peeling member 78 is arranged to mechanically peel off (remove) a recording medium sheet 91 stuck on the fix roller 31, or the press roller 32.

The press roller 32 is provided with a core 71, an elastic layer 72, and an intermediate layer 73. The core 71 (3 mm in wall thickness) is conductive and made of iron, stainless, or the like. The elastic layer is heat resistive and electric insulating, and is made of silicone rubber or the like. The intermediate layer 73 is formed on/above an outer surface of the elastic layer 72. On/above an outer surface of the intermediate layer 73, a releasing layer (surface resisting layer) for giving a surface of the press roller 32 a better releasing performance. That is, the press roller 32 is provided with the core 71 in a cylinder-like shape, the elastic layer 72 formed, in a cylinder tube-like shape, on/above the outer surface of the core 71, and the releasing layer 74 formed, in a cylinder tube-like shape, on the outer surface of the elastic layer 72. Moreover, between the elastic layer 72 and the releasing layer 74, the intermediate layer 73 is provided in such a manner that the intermediate layer 73 is bonded to the elastic layer 72 and the releasing layer 74.

The intermediate layer 73 gives better bonding to between the elastic layer 72 and the releasing layer 74. In the present embodiment, the intermediate layer 73 is an electric insulating primer, for the sake of easy bonding between the intermediate layer 73 and the elastic layer 72. Moreover, in the present embodiment, an external diameter of the intermediate layer 73 is set to 40 mm.

The releasing layer 74 of the press roller 32 is a PFA tube (film thickness 50 μm) having a surface resistivity of $10^{15}\Omega$ or higher. Note that the releasing layer 74 may be a PFA tube having a surface resistivity as much as $10^{5}\Omega$. However, a PFA tube having a surface resistivity in a range of from $10^7\Omega$ to $10^{18}\Omega$ is more preferable. Moreover, the PFA tube has a volumetric resistivity of $10^7$ Ω·cm or higher, more preferably of $10^{10}$ Ω·cm or higher.

The elastic layer 72 is prepared by shaping an electric insulating elastic material into a cylinder-tube like shape with a thickness (wall thickness) of 5 mm. Specifically, the elastic layer 72 is prepared as follows: setting, in a casting device, a casting mold in which the core 71 and the PFA tube are set; injecting into the casting mold the electric insulating elastic material; subjecting the elastic material to primary vulcanization; subjecting the elastic material to secondary vulcanization by using an oven; and then shaping edges portion of the elastic material. Note that the elastic material may be conductive even though it is electrically insulating in the present embodiment.

The elastic material is prepared by mixing and kneading 18 parts by mass of a filler into a base rubber to even dispersion. The filler has a substantially spherical shape, low heat conductivity and low heat capacity (the filler is a defoamed filler having a heat conductivity much lower than that of the base rubber). Here, the base rubber is a defoamed silicone rubber (made by Shin-Etsu Chemical Co., Ltd.), whereas the filler is glass balloon having a particle diameter of 100 μm. Note that the "part by mass" indicates a mass ration between the materials to be mixed and kneaded. To "mix and knead 18 parts by mass of a filler" indicates that, 18 grams of the filler is mixed and kneaded in per 100 grams of the base rubber.

It is arranged such that a volumetric ratio of the filler to the elastic material (total of the base rubber and the filler) is in a range of 15% to 80%, approximately.

If the volumetric ratio of the filler to the elastic material was too high (over 80%), then the elastic materials thus produced would have an excessively high rubber hardness, thereby making it difficult to attain a predetermined rubber hardness. Moreover, such excessively high volumetric ratio of the filler to the elastic material would result in faster deterioration of the rubber under the conditions in which heat and load are applied, thereby leading to higher possibility of occurrence of "sag" (sudden reduction in hardness during usage), and consequently shorter life. On the other hand, if the volumetric ratio of the filler to the elastic material was too low (less than 15%), then the filler could only far less level of properties (later described heat transmission coefficient K1 of the press roller 32) than a desired level. This causes the elastic material to be almost indifferent from the conventional silicone rubber.

Note that the base rubber is not limited to the defoamed silicone rubber, and may be high temperature vulcanization type silicone rubber (HTV), addition reaction hardened type silicone rubber (LTV), condensation reaction hardened type silicone rubber (RTV), fluoride rubber, or mixtures thereof, provided that it is a silicone rubber based material. Specifically, for example, the base rubber may be: silicone rubber based materials such as dimethylsilicone rubber, phlorosilicone fluorosilicone rubber, methylphenylsilicone rubber, vinylsilicone rubber, and the like; fluoride rubbers such as vinylidene fluoride rubber, tetrafluoroethylene-propylene rubber, tetrafluoroethylene-perfluoromethylvinylether rubber, phosphagen-type fluoride rubber, fluoropolyether, and the like; and the like rubbers. These rubbers may be used solely or two or more of them may be used in combination. Shaping of the rubbers is carried out by, for example, casting, vulcanizing, and then polishing.

Moreover, the filler to be mixed and kneaded in the base rubber may be inorganic type or resin based material. The inorganic based material for the filler may be inorganic type glass, silica, carbon, alumina, zirconia, or the like and may be in a form of balloon (hollow), or in a form of micro beads, having high content of air holes. Further, the inorganic based material for the filler may be glass balloon (particle diameter: 100 μm) made by Tokai Industry.

Moreover, the resin based material for the filler may be resin type balloon or resin type micro beads having high content of air hole, and may be made of phenol resin, vinylidene chloride resin, a copolymer of vinylidene chloride and methacrylonitrile, acrylonitrile resin, or the like. Further, the resin based material for the filler may be micro balloon (particle diameter 80 μm) whose outer shell is made of acrylonitrile resin.

Note that the filler may have any size and shape as long as it can attain the desired properties (later described heat transmission coefficient K1). However, if the filler has too large particle diameter or too thick outer shell, then there would be such a problem that the volumetric ratio of the filler to the elastic material becomes too large. In such case, the filler cannot be mixed and kneaded into the base rubber evenly, thereby failing to attain even dispersion of the filler in the base rubber. This would result in failure of attaining the desirable property that supposed to be attained by mixing and kneading the filler in the base rubber. Further, in such case, there would be such a problem that the base rubber of the resultant elastic material becomes susceptible to deterioration with age, thus losing elastic property over a shorter period.

Therefore, it is necessary to select the volumetric ratio of the filler to the elastic material, the kind of the filler, and the kind of the base rubber, in order that the elastic material prepared by mixing and kneading the filler into the base rubber may have appropriate hardness (to be free from sudden significant sag) and the desirable property (the later described heat transmission coefficient K1 of the press roller 32).

The following explains the preferable size of the filler. For example, an upper limit of the particle diameter of the filler is preferably 200 μm or less. This makes it possible to achieve in the elastic material the effect of the mixing and kneading of the filler (the later described heat transmission coefficient K1 of the press roller 32).

Moreover, a lower limit of the particle diameter of the filler is preferably 50 μm or more, because of restriction in production, and in order to prevent reduction in the strength of the outer shell. However, it should be noted that the lower limit may be as much as 20 μm depending on production method of the filler. However, if it is so arranged that the particle diameter of the filler is very small, it is necessary to arrange such that the thickness (layer thickness) of the outer shell of the filler is high, in order to maintain the strength of the outer shell against external forces. If the outer shell of the filler was excessively thick, the filler could not have sufficient heat properties and thus would become heat transmissive. Because of this, the filler would become unable to give the press roller 32 the desirable property (the later described heat transmission coefficient K1 of the press roller 32).

Moreover, even though the filler to be mixed and kneaded into the base rubber is spherical in the above, the filler may be elliptical, planiform, or non-spherical. Further, the filler may have small grains and/or pores. That is, the filler is not limited to the spherical shape. Therefore, the preferable size of the filler may be set in terms of a particle diameter along major axis, a particle diameter along miner axis, equivalent particle diameter (an equivalent particle diameter of circumscribing circle, an equivalent particle diameter of peripheral circle, an equivalent particle diameter of volumetric sphere, which are defined by particle diameter equivalent to a particle diameter of an inscribing or circumscribing circle), mean particle diameter (an mean particle diameter between two axes, an mean particle diameter among three axes or the like), statistic particle diameter (unidirectional tangent line particle diameter, unidirectional equally divided area particle diameter, unidirectional maximum particle diameter), effective particle diameter (Stokes (sedimentation) particle diameter, Allen (sedimentation) particle diameter, Newton (sedimentation) particle diameter), even though the preferable size of the filler is explained in the above referring to the particle diameter of a shape having a geometric mean. Moreover, the preferable size of the filler may be set according to the mean particle diameter calculated as mean particle diameter of the filler such as area mean particle diameter, number mean particle diameter, volume mean particle diameter (number mean volume particle diameter), weight mean particle diameter, harmony mean particle diameter, surface mean particle diameter (number mean surface particle diameter), length mean surface particle diameter, or as statistical particle diameter, equivalent particle diameter, or effective particle diameter of the filler.

As described above, the volumetric ratio of the filler to the elastic material is preferably in a range of 15% to 80% in the present embodiment. To realize such volumetric ratio, it is preferable that the particle diameter of the filler be 200 μm or less.

Figure 5:
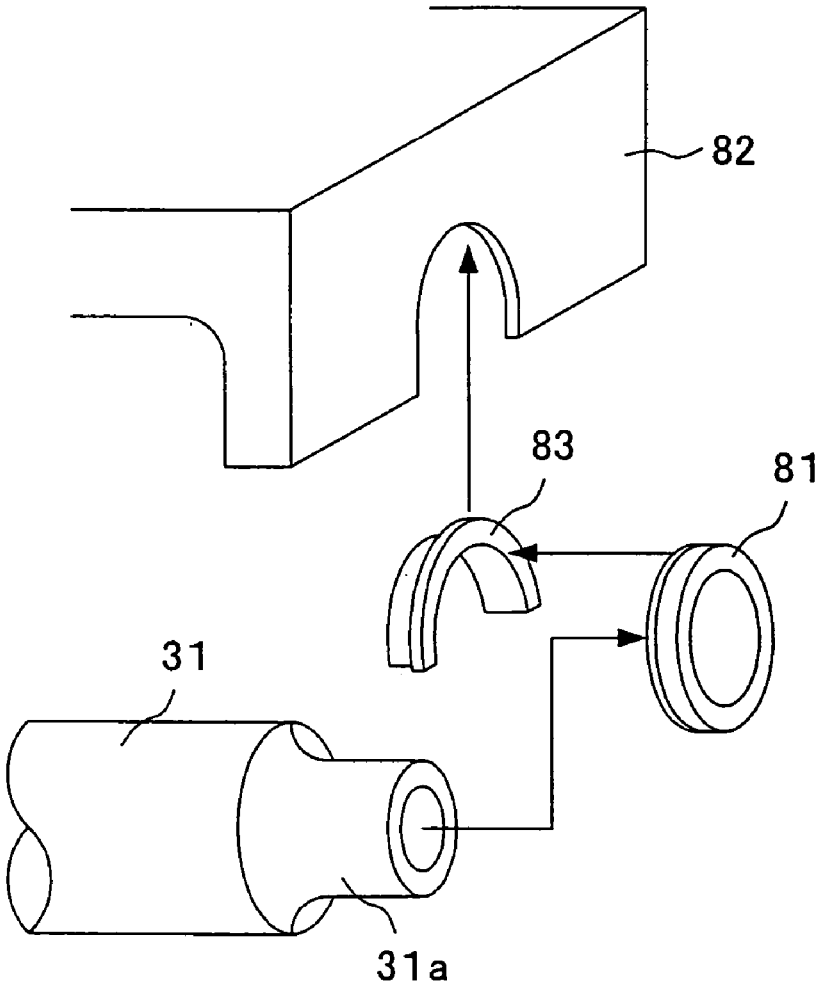
FIG. 5 is a exploded perspective view of the fix roller provided in the fixing device shown in FIG. 1.

The following explains the fix roller 31, referring to FIG. 5. FIG. 5 is an exploded perspective view of an assembly of the fix roller 31. The fix roller 31 is supported by the ball bearings 81 attached to a frame of the fixing apparatus 14. The frame 82 is prepared by press molding of iron-type cold rolled steel. The ball bearings 81 are engaged in journal sections of the narrowed ends of the fix roller 31, thereby holding weight of the fix roller 31.

On the other hand, in the press roller 32, ball bearings is engaged in an axial part made of stainless steel or the like. The ball bearing is supported by a load lever (extended from an axis of a supporting point) caulked to the frame. The ball bearing presses the fix roller 31 by using a load spring or the like toward the center axis of the fix roller 31. This force to press is 764N (sum of the force applied at both ends) in the present embodiment. However, the forced to press may be set arbitrarily depending of conditions and capacities such as the kind of the recording medium 91, stiffness of the fix roller 31 and the press roller 32, temperature of temperature conditioning.

The fix roller 31 and press roller 32 are pressed against each other with predetermined load (force). With the fix roller 31 and press roller 32, a toner image that has not been fixed yet is thermally melted and then fixed onto the recording medium 91 transported by the fix roller 31 and press roller 32 between which the recording medium 91 is sandwiched.

Further, the fixing device 14 of the present embodiment is provided with a first cleaning roller (potential applying (charging) member, cleaning member) 75, a second cleaning roller (potential applying (charging) member, cleaning member) 76, and a heating roller 77, which is a heating member. The first cleaning roller 75, the second cleaning roller 76, and the heating roller 77 are provided around the press roller 32 in such a manner that they are tangent to the press roller 32.

The first and second cleaning rollers 75 and 76 are made of aluminum, iron, or an alloy (which may be stainless steel) using aluminum or iron. The first and second cleaning rollers 75 and 76 may be hollow or may not be hollow. The first and second cleaning rollers are provided with radial bearings and antifriction bearings engaged at the respective ends. Further, the first and second cleaning rollers 75 and 76 are pressed against the press roller 32 by load springs or the like in such a manner that they respectively have a nip (nip portion) of a predetermined range with the press roller 32.

In the present embodiment, the second cleaning roller 76 is a roller having an external diameter of 15 mm and made of carbon steel or stainless steel, whereas the first cleaning roller 75 is a roller having an external diameter of 8 mm and made of carbon steel or stainless steel. The first and second cleaning rollers 75 and 76 have a surface having a predetermined roughness, so that a small amount of toner left on the press roller 32 can be removed by the first and second cleaning rollers 75 and 76.

On the other hand, the heating roller 77 is a hollow roller and made of aluminum, iron, or an alloy (which may be stainless steel) using aluminum or iron. The heating roller 77 is configured to heat the surface of the press roller 32 by heat conduction at a nip (nip portion) produced between the heating roller 77 and the press roller 32 by pressing the heating roller 77 against the press roller 32. The heating roller 77 is provided with a surface releasing layer 77*a* that consists an outer most circumferential surface of the heating roller 77. With the surface releasing layer 77*a*, the heating roller 77 can perform this heating without deteriorating its releasing performance.

The heating roller 77 in the present embodiment is provided with a straight pipe 77*b*, an intermediate layer 77*c* and the surface releasing layer 77*a*. The straight pipe 77*b* is 15 mm in an external diameter and 0.75 mm in wall thickness, and is made of aluminum alloy. The intermediate layer 77*c* and the surface releasing layer 77*a* are formed on/above an outer surface of the straight in this order. Moreover, the straight pipe 77*b* is provided with, on/above its inner circumferential surface, a heat resisting heat absorption layer 77*a*, as in the fix roller 31. The heat resisting heat absorption layer wraps a halogen lamp 77*d* therein.

The intermediate layer 77*c* and the surface releasing layer (surface electric insulating layer) 77*a* of the heating roller 77 may be arranged differently from the intermediate layer 62 and the releasing layer 63 of the fix roller 31. However, in the present embodiment, the intermediate layer 77*c* and the surface releasing layer (surface electric insulating layer) 77*a* of the heating roller 77 may be arranged same as the intermediate layer 62 and the releasing layer 63 of the fix roller 31. Moreover, the heating roller 77 is also provided with radial bearings or antifriction bearings engaged at respective ends, and pressed against the press roller 32 by a load spring or the like in such a manner that the heating roller 77 has a nip (nip portion) of a predetermined range with the press roller 32.

The ball bearings 81 engaged with the fix roller 31, as illustrated in FIG. 5, support the load via bearing holders 83 in an electrically insulting manner. The bearing holders 83 (see FIG. 2) are located between the frame 82 and the ball bearings 81, and are made of a heat resistive and electrically insulating material such as PPS resin (polyphenylene-sulfide), PPO resin (polyphenyleneoxide) or the like. The bearing holders 83 electrically insulate the fix roller 31 from the frame of the image forming device 41 and the frame of the fixing device 14.

As illustrated in FIG. 1, a bias voltage is applied from a bias device 94 onto the fix roller 31 in order to give a potential difference to the fix roller 31 so that reverse polarity toner (reverse polarity developer) 92, which is attached on a back surface of the recording medium 91, will be retained thereon.

Moreover, in the present embodiment, the transferring device 5 illustrated in FIG. 3 is configured to perform touching-type transferring. The transferring device 5 may be a belt type meanwhile a roller type transferring device is illustrated in FIG. 3. Note that, as illustrated in FIG. 1, the toner 93 attached on that surface of the recording medium 91 which faces toward the fix roller 31 is toner with which the image is formed.

Here, the transferring device 5 is located in an upper stream of the fixing device 14 in a transporting direction of the recording medium 91. The transferring device 5 transfers the toner image onto the recording medium 91, the toner image being the electrostatic image visualized on the photosensitive drum 1 by using the toner. During the transferring, the reverse polarity toner 92 is caused to attach with the surface of the transferring device 5, and then transferred from the surface of the transferring device 5 to the surface of the recording medium.

The transferring device 5 is generally provided with a system of removing the reverse polarity toner, paper dusts and the like therefrom. However, in most of cases, the reverse polarity toner, paper dusts and the like cannot be completely removed from the transferring device and accumulated on the surface thereof. Depending on balance in electrical attachment force, mechanical attachment force or the like, part or all of the accumulated reverse polarity toner, paper dusts and the like are caused to attach on the recording medium 91, and then transferred to the fix device 14 located in the downstream.

In general, the reverse polarity toner, paper dusts, and the like are delivered out from the image forming device, together with the recording medium on which they are attached. However, the conventional fixing device has such a problem that fixing for a large number of sheets of the recording medium would cause removal of the reverse polarity toner from the recording medium and subsequent migration of the thus removed reverse polarity toner from the recording medium to the press roller and further to the fix roller, depending on the conditions of the fixing device, especially on magnitude and polarity of electrostatic force caused by electrification of the fix roller and the press roller due to friction. The migration of the reverse polarity toner to the rollers causes defective image formation or other problems on the front and back surfaces of the recording medium.

However, the fixing device 14 in the present embodiment is so arranged that a fixing bias voltage is applied on the conductive core 61 of the fix roller 31 by the bias device 94. The fixing bias voltage is opposite in polarity with respect to the polarity of the reverse polarity toner 92 (for example, the fixing bias voltage is negative if the reverse polarity toner 92 is electrified positively).

With this arrangement, the fixing bias voltage applied from the bias device 94 onto the core 61 of the fix roller 3 causes electrostatic force that exerts on the back surface of the recording medium 91 so that the reverse polarity toner 92 will be retained on the back surface of the recording medium 91. In this way, the reverse polarity toner 92 will be retained on the recording medium 91 and will not be removed therefrom to migrate to the press roller 32 and the like. As a result, the reverse polarity toner 92 is delivered out together with the recording medium 91 on the back surface of which the reverse polarity toner 92 is attached. Note that an amount of the reverse polarity toner 92 on each sheet of the recording medium 91 is so small that the fixed image is almost unaffected with the attachment of the reverse polarity toner 92.

The fixing device 14 according to the present embodiment is further explained below, referring to FIG. 2.

As illustrated in FIG. 2, the fixing roller 31 is internally provided with a halogen lamp 64*a* (see FIG. 1, rated power 820 W) and a halogen lamp 64*b* (see FIG. 1, rated power 450 W). The halogen lamp 64*a* for mainly heating a middle region of the fix roller 31 is a main lamp as first heating means. The halogen lamp 64*b* for mainly heating end region (which is a portion other than the middle region) of the fix roller 31 is a sub lamp as second heating means.

Moreover, the heating roller 77, which is tangent to the surface of the press roller 32, is internally provided with a halogen lamp 77*d* (rated power 500 W). The halogen lamp 77*d* is a heating lamp as third heating means, and functions to heat whole width of the heating roller 77.

In general, the heating means (first to third heating means) is so controlled by power control method (such as wave number control, phase control, or the like) as to output a predetermined power.

Note that the arrangement as to the heat region of the halogen lamp 64*a* (the region heated mainly by the halogen lamp 64*a*), and the heating region of halogen lamp 64*b* (the region heated mainly by the halogen lamp 64*b*) is not limited to this. For example, it may be arranged that the halogen lamp 64*a* heats the whole width of the fix roller 31 whereas the halogen lamp 64*b* heats the middle region of the fix roller 31, or in may be arranged that the halogen lamp 64*b* heats the whole width of the fix roller 31 whereas the halogen lamp 64*a* heats the middle region of the fix roller 31. Further, even though in this arrangement the fix roller 31 contains the two halogen lamps therein, the present invention is not limited to this arrangement, and the fix roller 31 may contains three or more halogen lamps or a single lamp.

Moreover, as illustrated in FIG. 2, in a vicinity of the middle of the fix roller 31 in its longitudinal direction, a main thermistor 66*a* (see FIG. 1) as first temperature detector means, and a sub thermistor 66*b* as second temperature detector means. The subs thermistor 66*b* is located farer from a driving source than is the main thermistor 66*a*. Further, as illustrated in FIG. 1, a thermostat 65 is provided near the surface of the fix roller 31. The thermostat 65 is overheating prevention means.

The main thermistor 66*a* is a temperature detection element for measuring temperature in the middle region of the fix roller 31, and is used for controlling power supply to the halogen lamp 64*a*. The sub thermistor 66*b* is a temperature detection element for measuring temperature in a region with which recording media of some sizes are not in contact but recording media of the other sizes (larger than the some sizes) are in contact when they pass between the fix roller 31 and the press roller 32. The sub thermistor 66*b* is used for controlling power supply to the halogen lamp 64*b*. The thermostat 65 is used for stopping the power supply to the halogen lamps 64*a* and 64*b* when the temperature becomes abnormally high.

Further, a thermistor 79 (see FIG. 1) is provided hear a middle of the heading roller 77 in its longitudinal direction. The thermistor 79 is third temperature detector means for measuring temperature of the heating roller 77, and is used for controlling power supply to the halogen lamp 77*d*.

Figure 17A:
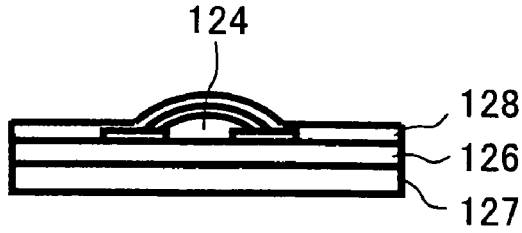
FIG. 17(*a*) is a front view illustrating a thermistor of an embodiment according to the present invention, whereas FIG. 17(*b*9 is a plan view illustrating the thermistor.
Figure 17B:
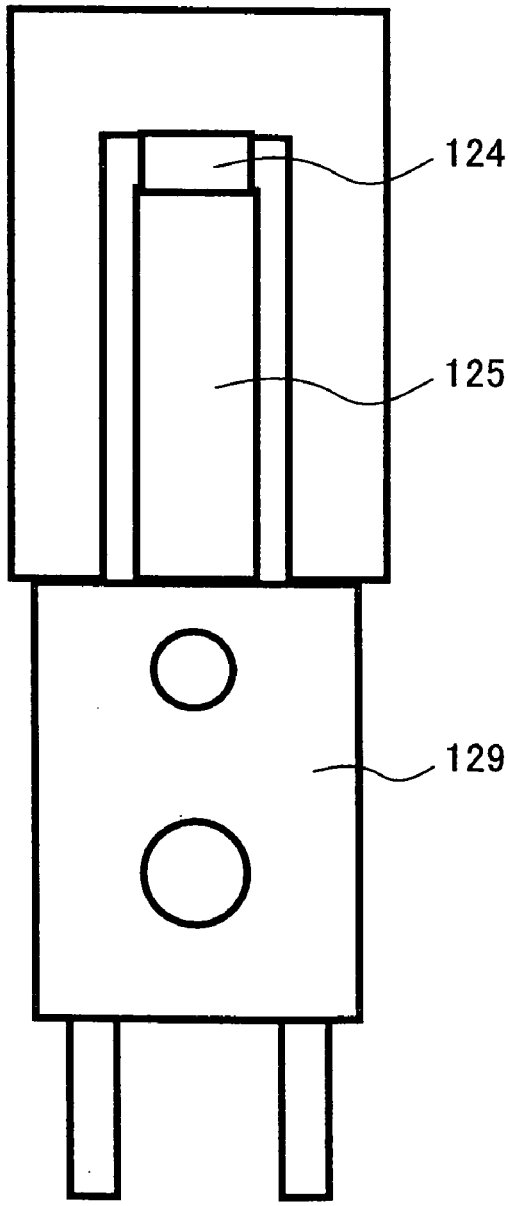

Note that, as illustrated in FIGS. 17(*a*) and 17(*b*), the thermistors 66*a*, 66*b*, and 79 used in the present embodiment are structured such that a thermistor chip 124 is directly bonded to a stainless board 125, which is an elastic member fixed to and supported by a housing 129. In this way, the thermistors 66*a*, 66*b*, and 79 attain a faster heat responding property.

Moreover, the thermistors 66*a*, 66*b*, and 79 in the present embodiment are so structured that a heat receiving surface of the stainless board 125, to which the thermistor chip 124 is bonded, is covered with an electric insulating cover layer 126. Further, the electric insulating cover layer 126 is covered with a heat resisting releasing layer 127. Moreover, that opposite surface of the stainless board 125, which is opposite to the heat receiving surface is covered with a protecting layer 128.

Regarding the arrangement between the stainless board 125 and the housing 129, the electric insulating cover layer 126, the heat resisting releasing layer 127, and the protecting layer 128 cover the stainless board 125 up to the vicinity of a border with the housing 129, in order to ensure an electric insulating distance from the surfaces of the respective rollers to which the thermistors are tangent. This arrangement prevents leak current from each roller to the thermistor chip 124 and the stainless board 125. This solves such drawbacks as damages or deterioration due to high voltage. As a result, it is possible to ensure application of stable bias voltage and accurate measurement of temperature. Thus, it becomes possible to perform excellent temperature control.

In the present embodiment, the electric insulating cover layer 126 is made of polyimide (Registered Trademark: Kapton) and has a thickness of 50 μm (the thickness includes an adhesive agent). The heat resisting releasing layer 127 is prepared by soaking glass fiber with a heat resisting releasing resin. The heat resisting releasing layer 127 has a thickness of 130 μm (the thickness includes an adhesive agent). The protecting layer 128 is made of Teflon (Registered Trademark) and has a thickness of 80 μm (the thickness includes an adhesive agent). Note that these layers are not limited to those materials, and may be made of other materials as long as the other materials can be substitution without sacrificing the property of the layers.

Next, the properties of the fix roller 31 and the press roller 32 of the fixing device 14 of the present embodiment are described in detail, referring to FIG. 6. FIG. 6 is a table listing parameters of various properties of the fix roller 31 and the press roller 32.

As illustrated in FIG. 6, the fix roller 31 has a heat transmission coefficient K2 of 5364 $W/m^2 \cdot K$, and the press roller 32 has a heat transmission coefficient K1 of 33.6 $W/m^2 \cdot K$. Moreover, the elastic layer 72 of the press roller 32, which is prepared by mixing in the base rubber the filler of low heat conductivity and how heat capacity, has heat conductivity of 0.17 W/m·K (nominal value).

Here, brief explanation on the heat transmission coefficient is provided. For example, a heat transmission coefficient of a material body a is a parameter showing how easily heat flux can pass through the material body a. The larger the parameter, the more easily the heat flux passes through the material body a. The heat transmission coefficient of the material body a is reciprocal to heat transmission resistance (heat resistance) of the material body a. Moreover, the heat transmission coefficient of the material body a can be calculated by dividing thickness of the material body a by heat conductivity of the material body a (that is, thickness of the material body a/heat conductivity of the material body a).

The following explains how to calculate out the coefficients of overall heat transmission of the fix roller 31 and the press roller 32. The fix roller 31 and the press roller 32 are not rollers made of sole material but made of various materials formed in multi layer structures. Therefore, the respective coefficients K1 and K2 of overall heat transmission of the fix roller 31 and the press roller 32 are equal to respective reciprocal numbers of sum of heat transmission resistance of each layer of the respective rollers. Thus, the heat transmission coefficient K1 of the press roller 32 in the present embodiment can be obtained from the following Equation 1, whereas the heat transmission coefficient K2 of the fix roller 31 in the present embodiment can be obtained from the following Equation 2:

$$K1=1/\{(t1/\lambda1)+(t2/\lambda2)+(t3/\lambda3)+(t7/\lambda7)\} \quad \text{Equation 1}$$

where t1: thickness (layer thickness) of Releasing Layer 74
λ1: heat conductivity of Releasing Layer 74
t2: thickness (diameter) of Core 71
λ2: heat conductivity of Core 71
t3: thickness of Elastic Layer 72
λ3: heat conductivity of Elastic Layer 72
t7: thickness of Intermediate Layer 73
λ7: heat conductivity of Intermediate Layer 73

$$K2=1/\{(t4/\lambda4)+(t5/\lambda5)+(t6/\lambda6) \quad \text{Equation 2}$$

where t4: thickness (wall thickness) of Core 61
λ4: heat conductivity of Core 61
t5: thickness of Releasing Layer 63
λ5: heat conductivity of Releasing Layer 63
t6: thickness of Intermediate Layer 62
λ6: heat conductivity of Intermediate Layer 62

Note that if the intermediate layer 73 is not provided or if the intermediate layer 73 is quite thin, (t7/λ7) can be omitted from Equation 1, even though the press roller 32 is provided with the intermediate layer 73 between the elastic layer 72 and the releasing layer 74 in the present embodiment.

Moreover, if the intermediate layer 62 is not provided or if the intermediate layer 62 is quite thin, (t6/λ6) can be omitted from Equation 2, even though the fix roller 31 is provided with the intermediate layer 62 between the core 61 and the releasing layer 63 in the present embodiment.

The fixing device 14 of the present embodiment is so arranged that the heat transmission coefficient K2 of the overall heat transmission of the fix roller 31 is much larger than the heat transmission coefficient K1 of the overall heat transmission of the press roller 32. Specifically, the heat transmission coefficient K2 of the overall heat transmission is set to be larger than the heat transmission coefficient K1 by the factor of less than 320 but not less than 100. That is, the fixing device 14 of the present embodiment is so arranged as to satisfy $(100 \cdot K1) \leqq (K2) \leqq (320 \cdot K1)$. The reason why it is so arranged is as follows.

The fix roller 31 is internally provided with the halogen lamps 64*a* and 64*b*. That is, the heating of the fix roller 31 need be carried out by heating the fix roller 31 from its inside. Thus, the fix roller 31 need a high heating efficiency and high heat responsibility (that is, the fix roller 31 need be able to transmit more heat in a shorter time). In the other words, it is necessary that the fix roller 31 have high heat transmission coefficient.

Moreover, the fix roller 31 is pressed against the press roller 32 to be tangent thereto. Thus, if the heat transmission coefficient K1 of the press roller 32 is relatively higher than the heat transmission coefficient K2 of the fix roller 31, the heat transmission from the fix roller 31 to the press roller 32 becomes more easy, and the heating efficiency and the heat responsibility of the fix roller 31 becomes low.

Therefore, in order to improve the heating efficiency and the heat responsibility of the fix roller 31, the press roller 32 needs relatively higher adiabatic performance than that of the fix roller 31, in addition to low adiabatic performance, that is, high heating performance of the fix roller 31. Because of these, it is necessary that coefficient K2 be much larger than coefficient K1.

In order to clearly show the property of the fixing device 14 in the present embodiment, a comparison experiment was conducted to compare the fixing device 14 and a comparative fixing device. Note that the comparative fixing device was so arranged that a core of its fix roller was made of aluminum alloy and an elastic layer of its press roller was made of silicone rubber which contained no filler. The property of the fix roller of the comparative fixing device is illustrated in Table 1, whereas the press roller thereof is illustrated in Table 2.

TABLE 1

| | |
|---|---|
| Material of Core | Aluminum Alloy |
| Thickness (Wall Thickness) of Core | 7 mm |
| Coefficient of Overall Heat Transmission | 5357 $W/M^2 \cdot K$ |
| Material of Releasing Layer | PFA/PTFE Mixture |
| Thickness (layer Thickness) of Releasing Layer | 25 μm |

TABLE 2

| | |
|---|---|
| Material of Core | STKM13A |
| Thickness (wall thickness) of Core | 3 mm |
| Coefficient of Overall Heat Transmission | 73.5 $W/m^2 \cdot K$ |
| Material of Releasing Layer | PFA tube |
| Thickness (layer thickness) of Releasing layer | 50 μm |
| Material of Elastic Layer | Silicone Rubber (no filler added) |
| Thickness (layer thickness) of Elastic Layer | 6 mm |

The following explains difference between the fix roller 31 of the fixing device 14 of the present embodiment and the fix roller of the comparative fixing device.

The comparative fix roller had the core made of aluminum alloy and having thickness (wall thickness) of 7 mm approximately. It was common to the fixing device of the present embodiment and the comparative fixing device that it was necessary to apply a predetermined load on their fixing rollers. Thus, if an aluminum-based material (aluminum or an alloy thereof) is used as the material of the core of a fix roller as in the comparative fixing device, it is necessary that the core have a wall thickness of 7 mm approximately in view of the theory of structures.

If it is so arranged that, as in the comparative fixing device, the material of the core of the fix roller is the aluminum-base material and the thickness (wall thickness) of the core is 7 mm approximately, the fixing roller will have heat transmission coefficient of 5357 $W/m^2 \cdot K$, thereby improving higher heat conductivity in the fix roller itself. However, the fix roller of the comparative fixing roller has a larger heat capacity than that of the fix roller 31 of the present embodiment due to the greater thickness of the core (the thickness of the fixing roller 31 of the present embodiment is 1.3 mm). Thus, warm-up time for the fix roller is longer in the comparative fixing device.

On the other hand, the fix roller 31 of the present embodiment has the core 61 made of the iron based material. The heat conductivity of the core 61 of the present embodiment is 45 W/m·K. Even though the heat conductivity of the core 61 is much lower than that of the core made of the aluminum-based material, the thin thickness of the core 61 gives the core 61 high heat transmission coefficient. The reason is as follows. The use of the iron based material for the core 61 as in the present invention allows the core 61 to have much thinner thickness (wall thickness) than the comparative fixing device, because the core 61 made of the iron based material is not so structurally restricted as in the core in the comparative fixing device. Thus, the fixing device 14 of the present embodiment is so arranged that the core 61 is thinner (1.3 mm) than that of the comparative device. With this arrangement, it is possible to effectively attain high heat transmission coefficient of the fix roller 31 as a whole (K2=5364 $W/m^2 \cdot K$), without having high heat capacity.

In terms of absorption amount, the fixing roller 31 of the present embodiment has heat absorption amount of $1.61 \times 10^8$ $J^2/s \cdot m^4 \cdot K^2$, whereas the fix roller of the comparative fixing device has heat absorption amount of $5.23 \times 10^8$ $J^2/s \cdot m^4 \cdot K^2$. This comparison shows that, even if the same amount of heat is supplied, the temperature of the fix roller of the comparative fixing device is not increased as much as that of the fix roller 31 of the present embodiment. Note that the heat absorption amount is product of density, specific heat, and heat conductivity. A material having a smaller heat absorption amount is easier to heat up (temperature thereof can be increased with a smaller amount of heat).

Next, difference between the press roller 32 of the fixing device 14 of the present embodiment and the press roller of the comparative fixing device is explained below.

The elastic layer of the press roller of the comparative fixing device was made of silicone rubber in which, unlike the present embodiment, no filler of low heat conductivity and low heat capacity was mixed. The silicone rubber had heat conductivity of about 0.45 W/m·K. If the elastic layer had a thickness (layer thickness) of 6 mm, the press roller had 73.5 $W/m^2 \cdot K$.

In this point, the elastic layer 72 of the press roller 32 of the present embodiment was made of the silicone rubber in which the filler of low heat conductivity and low heat capacity was mixed. Because of this, it was possible to give the press roller 32 heat transmission coefficient K1 of 33.6 $W/m^2 \cdot K$.

Thus, the press roller of the fixing device of the comparative fixing device was twice or more greater in heat transmission coefficient K1 than the press roller 32 of the present embodiment. This indicates that the press roller 32 has better adiabatic performance by the arrangement in which the elastic layer thereof is made of the silicone rubber in which the filler of low heat capacity is mixed.

Moreover, in terms of the heat absorption amount, the press roller 32 of the present embodiment had heat absorption amount of $1.87 \times 10^5$ $J^2/s \cdot m^4 \cdot K^2$, whereas the press roller of the comparative fixing device had heat absorption amount of $8.62 \times 10^5$ $J^2/s \cdot m^4 \cdot K^2$.

This comparison indicates that the elastic layer of the press roller 32 of the present embodiment is more adiabatic even though the elastic layer has a surface that is easy to heat up. Thus, the present embodiment is more excellent in rapid heating performance, because the smaller amount of heat, that is, shorter heating can increase the temperature of the press roller 32 so as to move to sheet transport operation in a shorter time in the present embodiment. Moreover, the press roller 32 of the present embodiment is more excellent in the adiabatic performance in the press roller of the comparative fixing device.

Next, the difference between the fixing device 14 of the present embodiment and the comparative fixing device is discussed below, in terms of a ratio between the coefficients of overall heat transmission of them. A ratio between the coefficients of overall heat transmission of press roller 23 and fix roller 31 of the present embodiment is as follows:

$$K1:K2=1:159.6$$

where K1 is heat transmission coefficient of the press roller 32, and K2 is heat transmission coefficient of the fix roller 31.

On the other hand, a ratio between the coefficients of overall heat transmission of the press roller and fix roller of the comparative fixing device is as follows:

$$k1:k2=1:72.8$$

where k1 is heat transmission coefficient of the press roller of the comparative fixing device, and k2 is heat transmission coefficient of the fix roller of the comparative fixing device.

This shows that the arrangement in the present embodiment has a larger ratio between the coefficients of overall heat transmission between the press roller and the fix roller than the arrangement of the comparative fixing device. Thus, the fixing device 14 of the present embodiment has better heat responding property than the comparative fixing device, and thus has shorter warm-up time.

Moreover, it is possible to adjust the heat transmission coefficient K1 of the press roller 32 by appropriately selecting the material, size, or the like, of the filler in producing the elastic material of the elastic layer 72 of the press roller 32. Even if the fix roller 31 is made of a material that is hard to heat up, this arrangement attains shorter warm-up time of the fixing device 14 by satisfying $(100 \cdot K1) \leqq (K2) \leqq (320 \cdot K1)$.

Figures 7, 8:
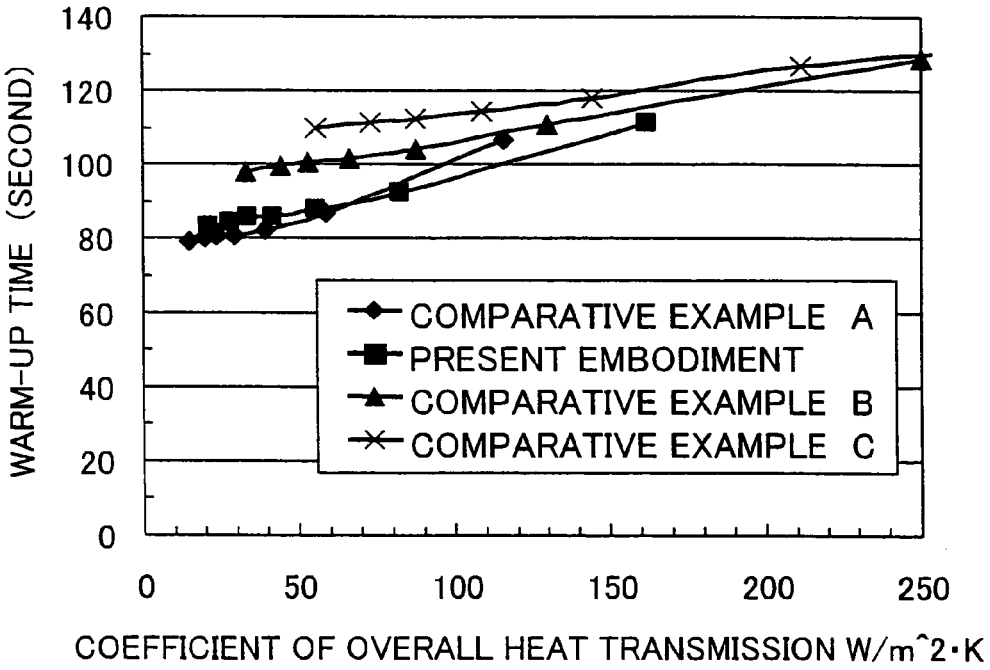
FIG. 7 is a table illustrating results of comparison between the fixing device shown in FIG. 1 and a conventional fixing device in terms of warm-up time and power consumption.
FIG. 8 is a graph illustrating results of comparison between the fixing device shown in FIG. 1 and a comparative fixing device in terms of warm-up time and heat transmission coefficient.

Next, FIG. 7 illustrates results of comparison between the fixing device 14 of the present embodiment and the comparative fixing device in terms of the warm-up time and the power consumption.

According to FIG. 7, a shorter warm-up time and smaller power consumption are attained in the fixing device 14 of the present embodiment. Note that in FIG. 7 "W.U.T" stands for Warm-Up time and "During WUP" stands for "During warming-up".

Next, advantages of the elastic layer 72 of the press roller 32 in the present embodiment are explained below. A comparison experiment in terms of relationship between the heat transmission coefficient and the warm-up time was carried out, in order to clearly show the advantages. Results of the comparison experiment is illustrated in FIG. 8. Note that the fixing device 14 of the present embodiment was compared with Comparative Examples A to C.

Comparative Example A is a fixing device in which a press roller has an elastic layer having a lower heat conductivity than the elastic layer 72 of the present embodiment, the elastic layer having different composition and containing a filler having lower heat conductivity by having a different material, structure, and particle diameter. Comparative Example B is a fixing device in which an elastic layer of the press roller is made of a modified silicone rubber (in which no filler is mixed). Comparative Example C is a fixing device in which an elastic layer of a press roller is made of silicone rubber (in which no filler is mixed), and a core of a fix roller is made of aluminum alloy.

Note that the fixing device of Comparative Example B in which the silicone rubber (no filler is added) is modified is such a fixing device that is modified to have the lower heat conductivity by slightly modifying the silicone rubber (to be a base rubber for the elastic layer) in terms of (a) composition regarding the filler (silica or the like), a plasticizer, an additive, and the like, (b) cross-linking/hardening conditions, and (c) molecular structure (kind of side chain, structure, and the like). By arranging, as in the present embodiment and the Comparative Example A, to have a lower heat transmission coefficient, it is possible to attain shorter warm-up time.

As shown in FIG. 8, it was found that, if warm-up time of 120 seconds or less is required in required specification (process speed: 395 mm/s, copying speed: 70 sheets/min) of the image forming device, it is desirable that the heat transmission coefficient of the press roller be 150 $W/m^2 \cdot K$ or less.

Here, the thicker thickness (wall thickness) of the elastic layer of the press roller can give lower heat transmission coefficient of the press roller. On the other hand, there is the upper limit in the thickness of the elastic layer, in view of the structural restriction (flexure, stress distribution) and heat capacity of the press roller. For example, if the press roller has a diameter of 40 mm, it is preferable that the elastic layer has an upper limit of about 8 mm. In this case, the lower limit of the heat transmission coefficient of the press roller is 15 $W/m^2 \cdot K$.

However, in order to have more stable adiabatic performance, and good balance between the structural restriction and the life (to avoid reduction in the elastic property due to reduction in instinct resilience in the silicone rubber located on the surface of the elastic layer and consequent decreased in hardness therein as a result of permanent shrinking and distortion thereof), it is most preferable that the coefficient of the overall heat transmission of the press roller be not less than 20 $W/m^2 \cdot K$ but not more than 100 $W/m^2 \cdot K$.

Figure 9:
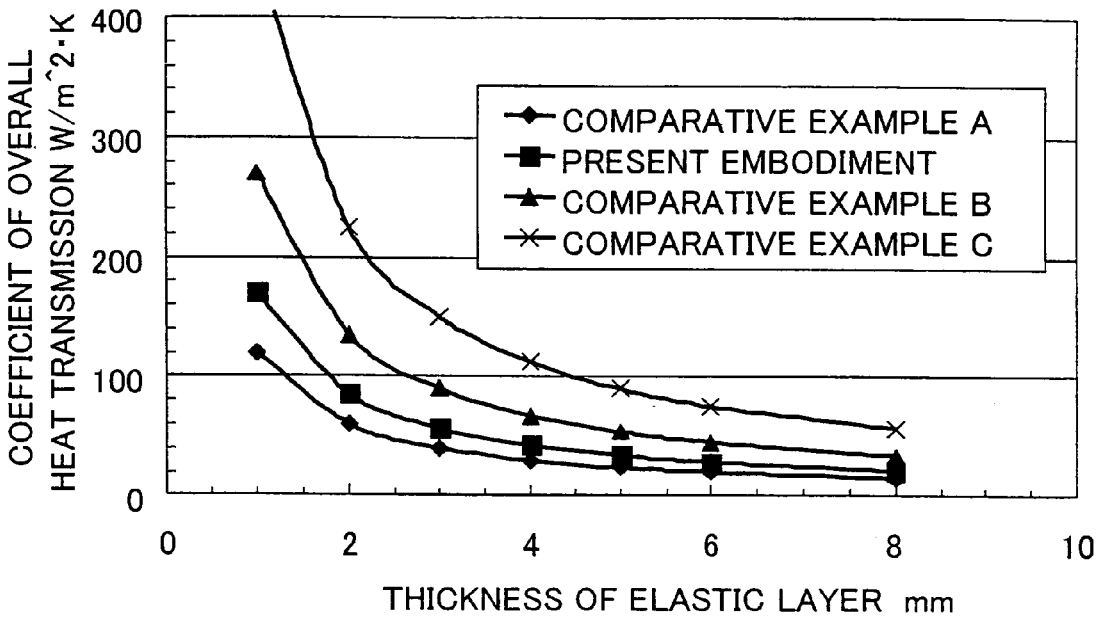
FIG. 9 is a graph illustrating results of comparison between the fixing device shown in FIG. 1 and the comparative fixing device in terms of relationship between heat transmission coefficient and thickness (layer thickness) of an elastic layer.

Further, FIG. 9 illustrates results of a comparison experiment on relationship between the heat transmission coefficient and the thickness (layer thickness) of the elastic layer in the press roller. Note that Comparative Examples A to C in FIG. 9 are identical with those in FIG. 8.

According to FIG. 9, as the thickness of the elastic layer of the press roller is thinner and as the heat conductivity of the elastic layer is larger, the heat transmission coefficient of the press roller becomes larger and the adiabatic performance of the press roller becomes lower. Moreover, if a thickness of less than about 2 mm of the elastic layer of the press roller causes dramatic increase in the heat transmission coefficient, thereby resulting in reduction in the adiabatic performance.

This is because, even in a material having low heat conductivity, the heat flux passes through the material in very short time if the thickness of the material is thinner than its appropriate thickness that allows the materials to have sufficient adiabatic performance. Such thin elastic layer of the press roller allows the heat flux to pass through the elastic layer in such a short time thereby allowing the core to deprive the heat from the elastic layer. This result in significant reduction of the adiabatic performance of the press roller. While the above discusses the case of the elastic layer, the same is true for the other layers of the press roller.

Especially because the core of the press roller is a structural member and thus need be made of a material having higher tensile strength and larger young's modulus.

However, the use of the material having high tensile strength and large young's modulus gives the core higher heat capacity. In this case, the heat flux transmitted from the elastic layer to the core is stored in the core. However, if the core has excessively large heat capacity, the heat transmitted to the core is lost and wasted before the heat is used for fixing the image onto the recording medium (heat loss). Therefore, it is necessary that the core of the press roller have a wall thickness appropriate to give maximally restrain the heat loss.

In the present embodiment, the press roller 32 has the external diameter of 40 mm, whereas the elastic layer 72 of the press roller 32 has a thickness of 5 mm. Thus, in the present embodiment, the core 71 has the thickness of 3 mm. However, the thickness of the core 71 is not limited to this. The core 71 may have another thickness depending on the external diameter and structure of the roller, and the material of the core, and the like condition.

A life test was conducted for the arrangement of the image forming device 41 and fixing device 14 of the present embodiment. In the lift test, the sheets were transported at a copying speed of 70 sheet per minute. It was confirmed in the life test that even after having transporting 300,000 sheets or more, (a) the press roller 32 showed no significant change in its hardness, (b) no significant enlargement in the nip portion between the fix roller 31 and the press roller 32 was caused, and (c) no tangling of the sheet was caused.

As described above, according to the fixing device 14 of the present embodiment, it is possible to attain a shorter warm-up time, smaller power consumption, and longer life than in the comparative fixing device, and the fixing devices of Comparative Examples B and C. Even though in the conventional fixing device as described Reference 1, it is difficult to attain the short warm-up time and long life at the same time (that is, warm-up time and the life are in a trade-off relationship). However, according to the fixing device 14 of the present embodiment it is possible to attain the shorter warm-up time and longer life at the same time.

Note that in the present embodiment the core 61 of the fix roller 31 is made of the iron-based material. However, the core 61 of the fix roller 31 may be made of aluminum alloy as conventionally arranged, as long as it is satisfied that $(100 \cdot K1) \leqq (K2) \leqq (320 \cdot K1)$.

The present invention is not limited to the size, material, structure, shape, and the like described in the present embodiment as above, and is not limited in terms of control method, heating method, and the size of the recording medium. That is, the present invention may be realized by appropriately combining various arrangements within the scope of the claims listed below.

[Second Embodiment]

Figure 10:
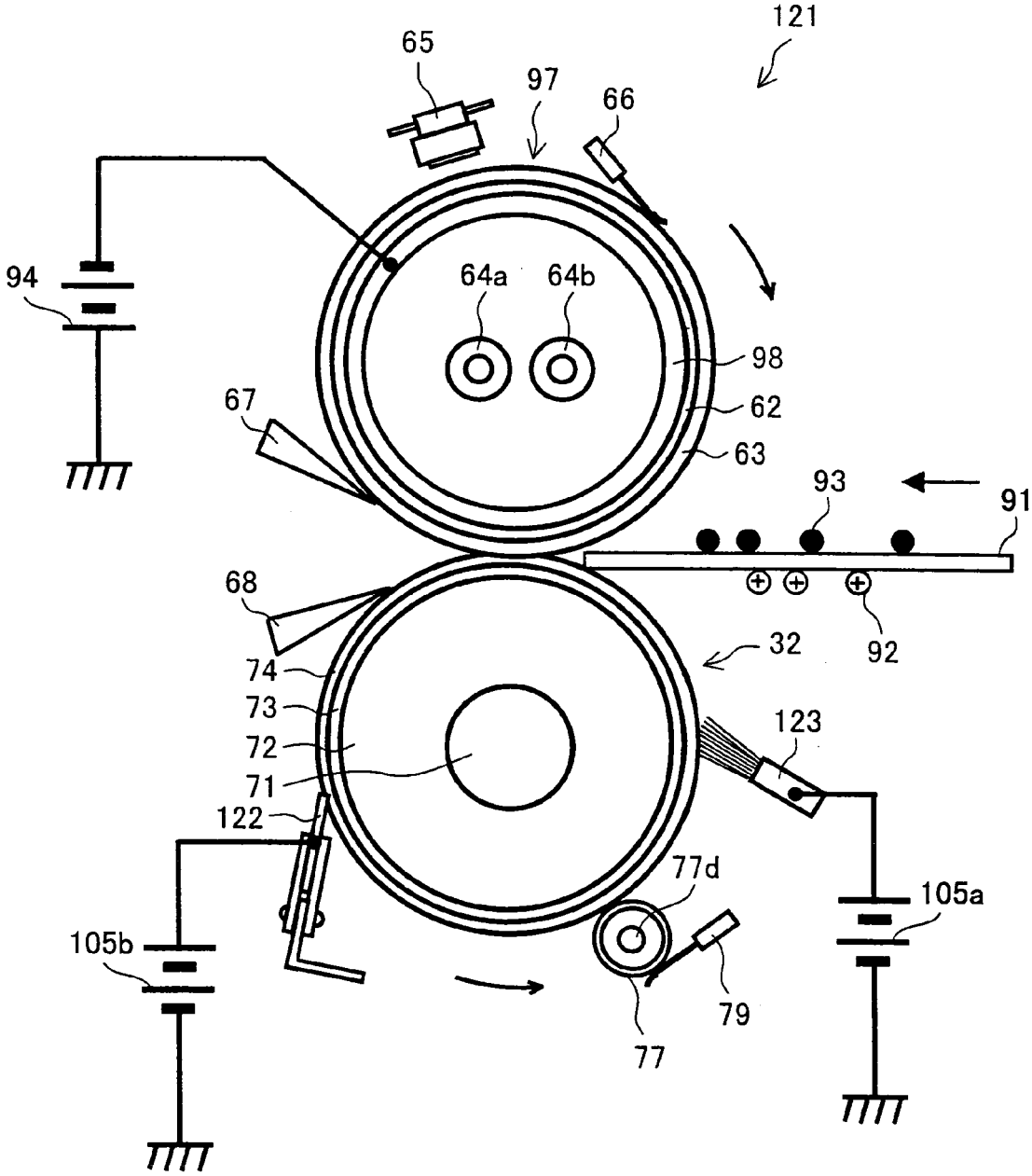
FIG. 10 is a vertical cross sectional view illustrating another embodiment according to the present invention.
Figure 11:
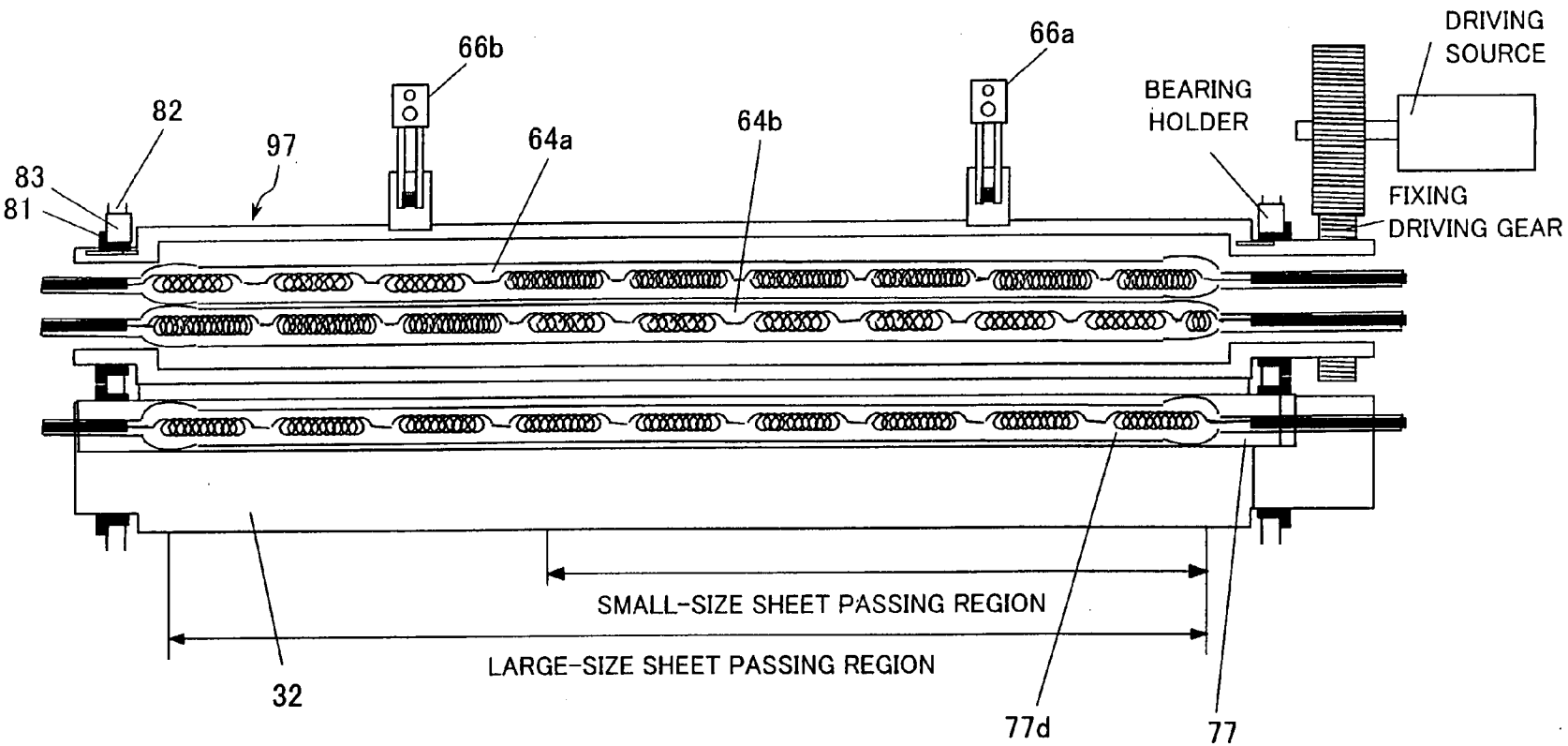
FIG. 11 is a front view illustrating a supporting structure of a fix roller and a press roller shown in FIG. 10.

Referring to FIGS. 10 and 11, another embodiment of the present invention is described below. Note that a fixing device according to the present embodiment has a basic structure same as that in the firs embodiment. Thus, explanation on the same member and feature is omitted here.

As in the first embodiment, the fixing device 121 of the present embodiment has a fix member (fix roller 97) and a press member (press roller 97), each of which is in a roller shape and has a conductive core. The fix roller 97 is provided with, for example, a core 98, an intermediate layer 62, and a releasing layer 63. The core 98 is narrowed at respective ends and has an external diameter of 40 mm.

The intermediate layer 62 and the releasing layer 63 are identical with those corresponding members in the first embodiment. The fix roller 97 of the present embodiment is different from the fix roller 31 of the first embodiment in terms of thickness (wall thickness) of the core 98: The core 98 of the fix roller 97 in the present invention is 0.4 mm. That is, the thickness of the core 98 of the fix roller 97 in the present embodiment is thinner than the core 61 of the fix roller 31.

Moreover, the fix roller 97 is internally provided with two halogen lamps 64*a* and 64*b* as shown in FIG. 11. With the halogen lamps 64*a* and 64*b*, the fix roller 97 performs heating-type fixing. In sheet transport, a sheet is so transported that an edge thereof is set with reference to a driving source side (the side associated with a driving source). As such, a small-size sheet passing region (through which sheets of small size are transported) is positioned in reference to the driving source side, as shown in FIG. 11. The halogen lamp 64*a* is configured to heat the small-size sheet passing region. The halogen lamp 64*b* is configured to heat the rest of the region located far from the driving source (that is, the region except the small-size sheet passing region). Moreover, the heating roller 77 is internally provided with a halogen lamp 77*d* (for heating the whole width of the heating roller 77).

Note that the press roller 32 and the heating roller 77 in the present embodiment are identical with those in the first embodiment.

Moreover, as shown in FIG. 10, the surface of the press roller 32 is tangent to the heating roller 77. Further, the press roller 32 is tangent to a scraper 122 in a downstream thereof in the transport direction of the recording medium 91, whereas the press roller 32 is tangent to a charging brush (potential applying (charging) member) 123 in an upstream thereof in the transport direction of the recording medium 91.

The scraper (potential applying (charging) member, cleaning member) 122 is a cleaning member to remove toner 93 from the press roller 32 by applying a potential of reverse polarity with respect to that of the toner 93. Note that the potential reverse to that of the toner 93 is given by a bias device 105*b*.

The potential applying brush 123 is an electric charge-removing brush to remove the electric charge accumulated in the surface of the press roller 32. In the present embodiment, a bias device 105*a* is connected to the potential applying brush 123, for attaining better electric charge removing effect. However, for attaining better electric charge removing effect it may be arranged that the potential applying brush 123 is grounded.

The bias device 105*a* is used to give a predetermined bias potential to the potential applying brush 123 for attaining better electric charge removing effect.

Moreover, a process speed of the press roller is, for example, 335 mm/s, and a transport speed of the recording medium 91 is, for example, 62 sheets per minute.

Further, rated apparatus powers of the halogen lamps 64*a*, 64*b*, and 77*d* are respectively identical with those in the first embodiment, with the difference that, in the present embodiment, heating along axial directions of the rollers is with reference to the driving source side.

The following provides detail explanation on the feature of the present embodiment. In the arrangement of the present embodiment, as described above, the core 98 of the fix roller 97 is thinner than the core 61 of the fix roller 31 of the first embodiment. With this arrangement, the fix roller 97 of the present embodiment has a larger heat transmission coefficient than that of the fix roller 31 of the first embodiment 1. Further, the fix roller 97 has a higher heat responsibility than the fix roller 31.

In the following, properties of the fix roller 97 and the press roller 32 of the present embodiment are explained. FIG. 12 is a table illustrating parameters of the properties of the fix roller 97 and the press roller 32 of the present embodiment.

As shown in FIG. 12, the fix roller 97 of the present embodiment has heat transmission coefficient K2 of 6009 $W/m^2 \cdot K$. Therefore, the fix roller 97 of the present embodiment is capable of transmitting more heat by 10% or more than the fix roller 31 of the first embodiment.

Further, the press roller 32 in the present embodiment is identical with that in the first embodiment. That is, the press roller 32 in the present embodiment has the same adiabatic performance as that in the first embodiment. As such, a ratio between the heat transmission coefficient K1 of the press roller 32 and the heat transmission coefficient K2 of the fix roller 97 in the present embodiment is larger than the ratio between the coefficients K1 and K2 in the first embodiment. Thus, it is possible to attain a shorter warm-up time for the fixing device.

Figure 13:
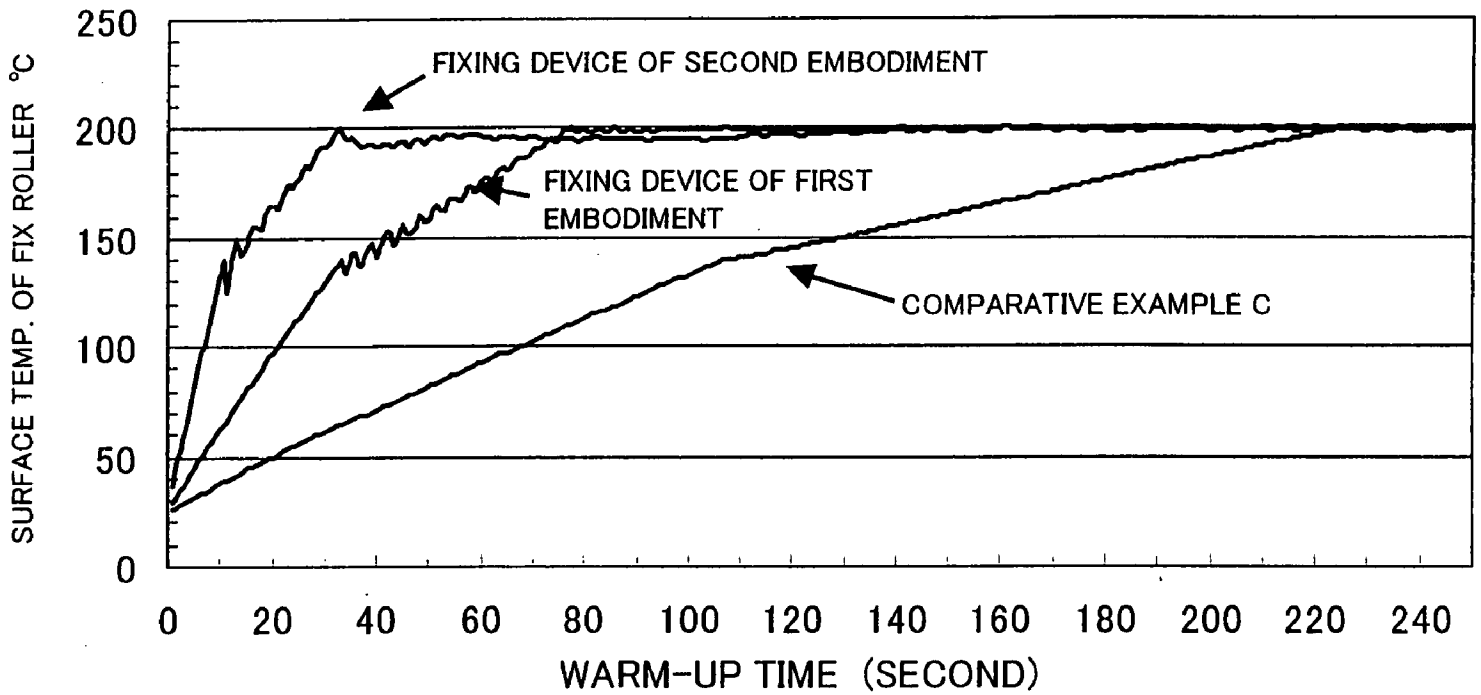
FIG. 13 is a graph illustrating results of comparison among the fixing devices shown in FIGS. 1 and 10, and comparative fixing devices in terms of relationship between surface temperature of the fixing rollers, and warm-up time (elapsed time).

Next, advantages of the fix roller 97 of the present embodiment is explained below. In order to clearly show the advantages, a comparison experiment was conducted on relationship between surface temperatures of the fix rollers and the warm-up times (elapsed times) of the fix rollers. Results of the comparison experiment are illustrated in FIG. 13. In the comparison experiment, the fixing device 121 of the present embodiment, the fixing device 14 of the first embodiment, and Comparison Example C (see the first embodiment and FIG. 8) described in the first embodiment were compared).

As clearly illustrated in FIG. 13, the fixing device 121 of the present embodiment can be warmed up within substantially half length of time compared with the fixing device 14 of the first embodiment, even though the press rollers in the respective embodiments have the same property. Moreover, the present embodiment can attain smaller power consumption in warming up and smaller power consumption in transporting 1000 sheets of the recording medium, than in the first embodiment. Thus, the present embodiment is more economical in power consumption than in the first embodiment.

Next, relationship between the thickness of the elastic layer 72 of the press roller 32 and the warming up time is discussed below. FIG. 14 illustrates warming-up time, power consumption during the warming-up time, power consumption during sheet transport in cases of various thickness of the elastic layer 72 of the press roller 32 of the present embodiment. Note that, for the sake of comparison, FIG. 14 also illustrates warming-up time, power consumption during the warming-up time, power consumption during sheet transport in cases of various thickness of the elastic layer of the press roller of Comparison Example B described in the first embodiment.

As clearly shown in FIG. 14, 1 mm thickness of the elastic layer extremely extends the warm-up time. Moreover, also in Comparative Example B in which the elastic layer of the press roller is made of silicone rubber modified to have the lower heat conductivity, 1 mm thickness of the elastic layer dramatically extends the warm-up time than 2 mm thickness by 20 seconds or more.

Figure 15:
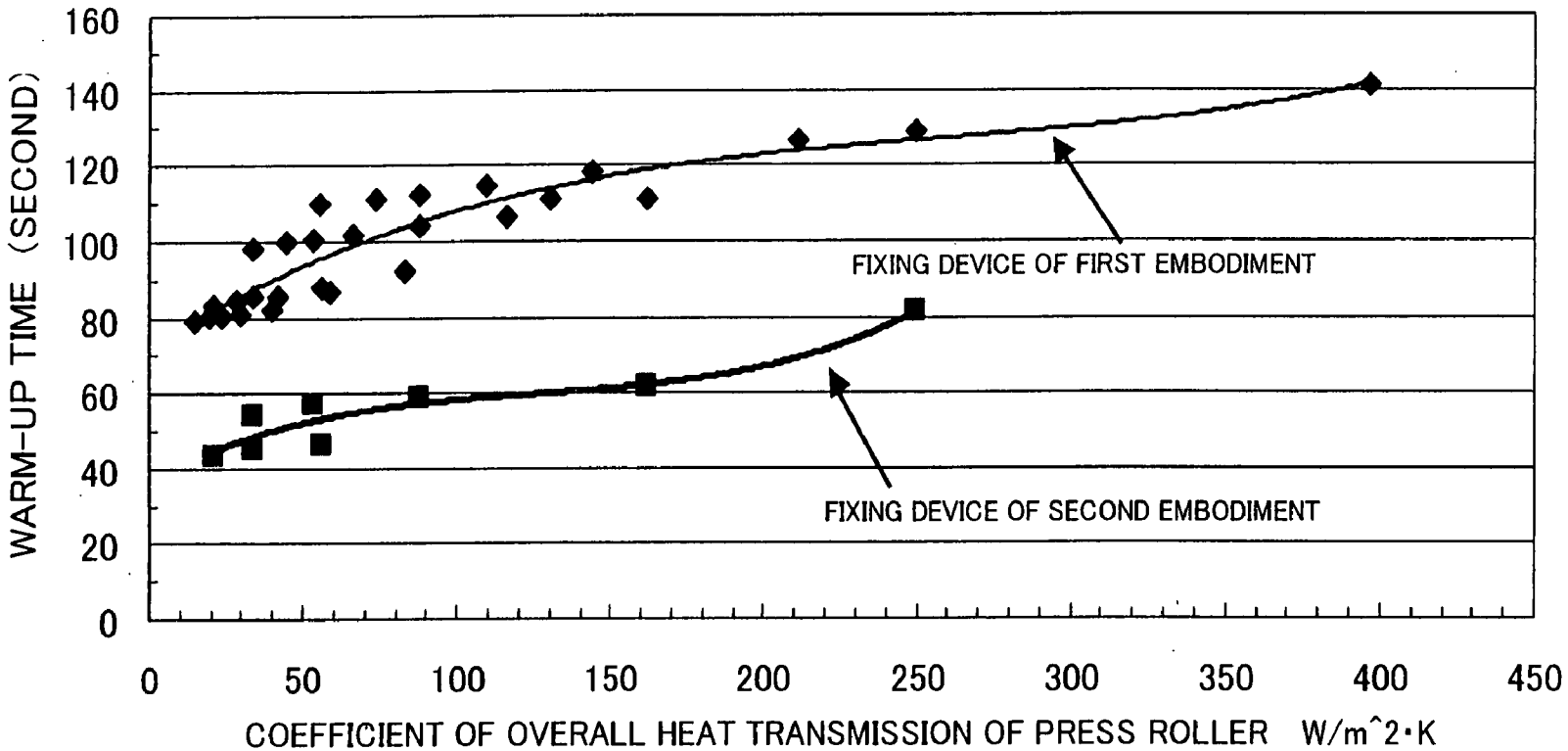
FIG. 15 is a graph illustrating relationship between the heat transmission coefficient of the press roller, and warm-up time, in the fixing device shown in FIG. 10 and the fixing device shown in FIG. 1.

Further, FIG. 15 illustrates results of comparison between the fixing device 121 of the present embodiment and the fixing device 14 of the first embodiment in terms of the coefficients of overall heat transmission of the press roller and the warm-up time.

The heat transmission coefficient of the press roller 32 of the present embodiment is related with the warming-up time as follows: at the coefficient of 150 $W/m^2 \cdot K$ or higher, there is a curve-changing region in which the warm-up time is dramatically increased. Therefore, for avoiding the increase in the warm-up time it is preferable that the heat transmission coefficient of the press roller 32 is 150 $W/m^2 \cdot K$ or higher.

Moreover, again in the present embodiment, it is possible to attain better heat transmission coefficient of the fix roller 97 by arranging such that the fix roller 97 is thin in thickness within the structural restriction, as in the first embodiment. Here, the core 98 of the fix roller 97 is made of an iron-based material. Therefore, it is possible to arrange such that the core 98 has a thickness in a range of 0.1 mm to 0.2 mm, approximately. Moreover, beside carbon steel, the core 98 may be made of chrome steel, manganese steel, nickel steel, chrome/molybdenum steel, stainless steel, or the like. Further, the core 98 may be made of a non-iron based material such as titanium, an alloy thereof, or the like. In addition, the core 98 may be made of a clad metal prepared by cladding two or more metals together. Those arrangements allow the core 61 to be thinner.

Further, the thickness (wall thickness) of the core 98 may be large within restriction given by the heat capacity of the fix roller 97. In case of a large fix roller 97, for example, having a diameter of 80 mm, upper limit of the core 98 in its thickness is about 15 mm if it is made of an aluminum alloy, and is about 4 mm if it is made of an iron-based material. With this arrangement, it is possible to ignore the structural restriction in the fix roller 97.

Therefore, in the case where the core 98 is made of the iron-based material, the core 98 may be designed to have a thickness in a range of 0.1 mm to 4 mm. In this case, the coefficient of the fix roller 97 is not less than 4000 $W/m^2 \cdot K$ but not more than 6400 $W/m^2 \cdot K$. However, it is more preferable that the coefficient of the fix roller 97 be not less than 4300 $W/m^2 \cdot K$ but not more than 6300 $W/m^2 \cdot K$.

As described above, the thickness of the core 61 of the fix roller 97 and the thickness of the elastic layer 72 and the core 71 of the press roller 23 are dependent on the diameters of the respective rollers and is limited by the structural restriction. Here, for the practical reasons, and the range of the heat transmission coefficient, it is preferable in the fix roller 97 that a ratio between the diameter and the thickness of the core 98 be as follows:

(diameter/thickness)=not less than 16 but not more than 220.

Moreover, it is preferable in the press roller 32 that a ratio between the diameter and the thickness of the elastic layer 72 be as follows:

(diameter/thickness)=not less than 3 but not more than 20.

Further, it is preferable in the press roller 32 that a ratio between the diameter and the thickness of the core 71 be as follows:

(diameter/thickness)=not less than 6 but not more than 11.

The reasons why these ratios are set are because the thinner core 98 gives the fix roller 97 better heat responsibility but the excessively thin core 98 cannot maintain the shape of the fix roller 97 structurally, and, in a worst case, leads to destruction of the fix roller 97. If the fix roller 97 is arranged such that the ratio between the diameter and the thickness of the core 98 is within the range, problems mentioned above will not be caused, that is, no practical problem will be caused in the use of the fix roller 97.

Moreover, if the press roller 32 is arranged such that the ratio between the diameter and the thickness of the core 71 is within the range, the heat capacity of the press roller 32 can be restrained, without deteriorating the heat transmission coefficient of the press roller 32. Further, if the press roller 32 is arranged such that the ratio between the diameter and the thickness of the elastic layer 72 is within the range, the heat capacity of the press roller can be reduced, without deteriorating the heat transmission coefficient of the press roller 32, and a long life of the elastic layer 72 can be attained.

Next, the following discusses the adiabatic property of the elastic member (silicone rubber in which the filler of the low heat capacity is mixed) of which the elastic layer 72 of the press roller 32 of the present embodiment is made. Specifically, for discussing the adiabatic property "equivalent thickness" is obtained, which indicates how adiabatic the elastic member is in relation with a glass wool, which is known as a general-use adiabatic material.

Here, the "equivalent thickness" is a thickness of a material, with which the material has an adiabatic performance equivalent to that of a glass wool having a thickness of 100 mm. That is, a thinner "equivalent thickness" indicates that the material has a higher adiabatic performance. From the "equivalent thickness", it is possible to judge whether a material in question is good or poor in adiabatic performance.

The "equivalent thickness" is calculated as follows. Supposing that equivalent thickness L of a material a having heat conductivity x is to be calculated, a fact that the material a having the heat conductivity x and the thickness x is equal to the glass wool having thickness of 100 mm indicates that the material a and the glass wool have the same coefficient of overall heat conductivity. Here, the coefficient of overall heat coefficient is (thickness of the material/heat conductivity of the material), thus:

$$(100/\text{heat conductivity of glass wool})=a/x \qquad \text{Equation 3.}$$

Further, Equation 3 is rewritten as:

$$L(\text{mm})=(\text{heat conductivity of material/heat conductivity of glass wool})\times 10 \qquad \text{Equation 4.}$$

Here, the heat conductivity of the glass wool is 0.05 W/m·K (nominal value).

FIG. 16 illustrates equivalent thickness of the elastic layer of the press roller 32 of the present embodiment, and of the elastic layers of Comparative Examples A to C described in the first embodiment.

From FIG. 16, it is found that the heat transmission coefficient of the press roller can be maintained low and the adiabatic performance can be improved when the equivalent thickness of the elastic layer is not less than 100 mm and not more than 500 mm.

In the other words, if the elastic layer 72 of the press roller 32 has 1 to 5 times greater heat conductivity than the glass wool, it is possible to attain the fixing device 121 in which the adiabatic performance of the press roller 32 is maintained but the press roller 32 will not disturb the heating of the fix roller 31.

To compare the conventionally available materials in terms of their adiabatic properties when processed into the elastic layer of the press member, it is not sufficient to compare them simply in terms of their instinct heat conductivity and thermal diffusivity. Moreover, it is not possible to efficiently increase the adiabatic performance of the elastic layer of the press roller by simply selecting the material having high adiabatic performance. However, from Equation 4, it is possible to efficiently improve the adiabatic performance of the elastic layer of the press roller, and thus to attain a fixing device having excellent warming-up performance.

As described above, according to the present embodiment the fixing device 121 can be arranged with a shorter warming-up time and within the structural restriction with respect to the fixing roller 97 and the press roller 32 (so as to avoid warping and twisting). Moreover, it is possible to maintain stable adiabatic performance and the elastic property in the elastic layer 72 of the press roller 32 in a longer time. That is, it is possible to attain the short warm-up time and long life in the whole fixing device 14.

The present invention is not limited to the size, material, structure, and the like described in the present embodiment as above. The present invention may be arranged that a primer layer is provided as the intermediate layer, or that the releasing layer or the elastic layer has a multi-layer structure. Moreover, the present invention is not limited in terms of control method, heating method, and the size of the recording medium. That is, the present invention may be realized by appropriately combining various arrangements within the scope of the claims listed below.

[Third Embodiment]

Figure 18:
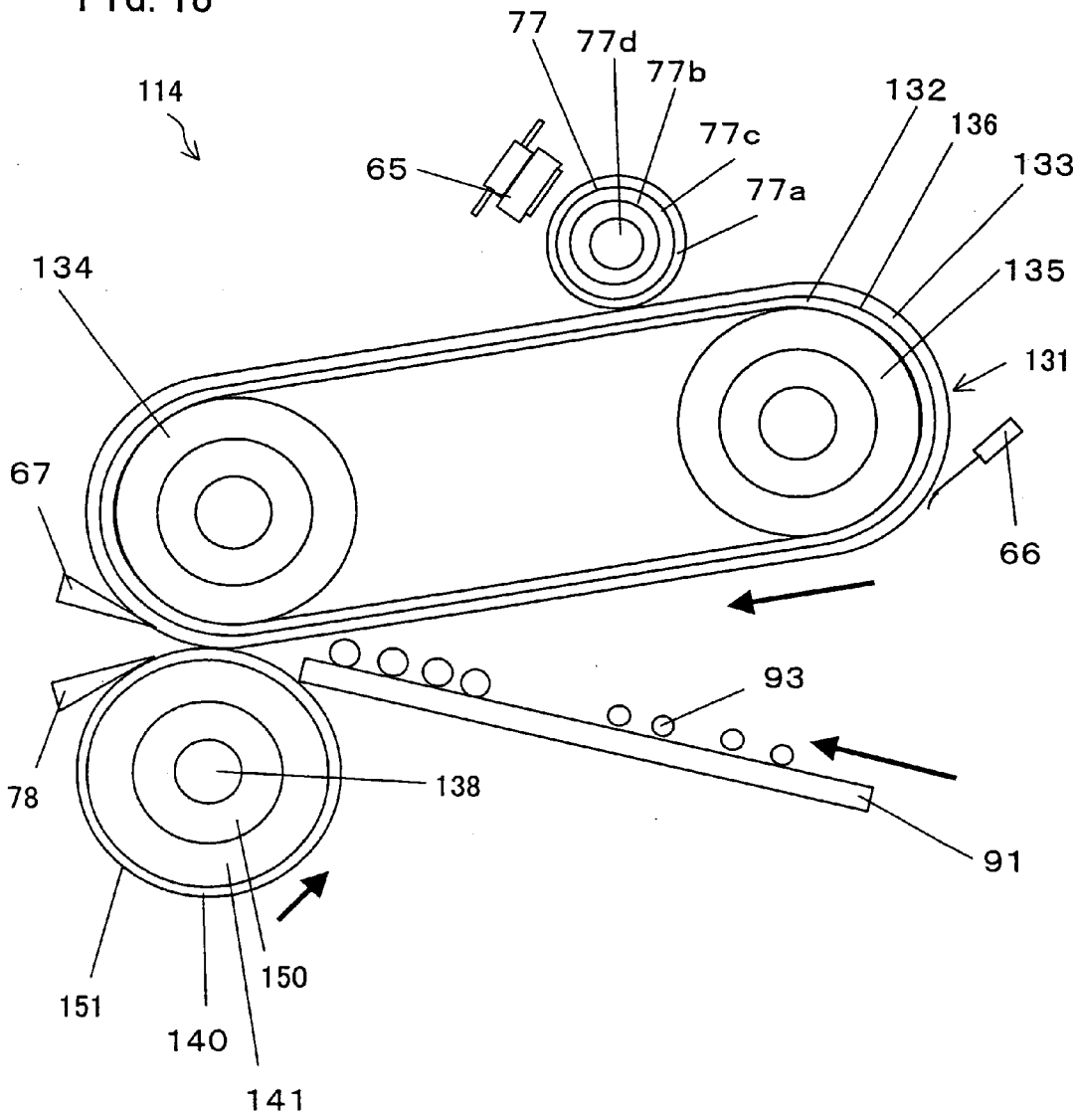
FIG. 18 is a vertical cross sectional view illustrating a fixing device of still another embodiment according to the present invention.

Still another embodiment of the present invention is explained below, referring to FIG. 18. Note that the explanation on the members identical to the corresponding member in the first embodiment is omitted here.

A fixing device 114 of the present embodiment is mainly applicable to a color image forming device. In the fixing device 114, a fix belt 131 is held by a driving roller 134 and a driven roller 135. Further there provided a heating roller 77 for heating the fix belt 131. The heating roller 77 also functions as a tension roller.

In the present embodiment, the fix belt 131 in the belt-like shape is provided as the fix member. The fix belt 131 is provided with a base belt (core) 132, a releasing layer 133, and a primer (intermediate layer) 136.

The base belt 132 is 125.7 mm in circumferential length and 0.55 mm in belt thickness (thickness), and is prepared from a Ni layer of 0.5 mm in thickness. (layer thickness). Moreover, on the base belt 132, PFA, which is conductive, is provided in about 30 μm thickness, as the releasing layer 133. The primer layer 136 is interposed therebetween.

The primer layer 136 is located between the releasing layer 133 and the base belt 132, and functions as the intermediate layer for improving bonding between the releasing layer 133 and the base belt 132. The releasing layer 133 has volume resistivity in a range of $10^9$ to $10^{10}$ Ω·cm and surface resistivity in a range of $10^7$ to $10^8$ Ω·cm.

Moreover, a press roller 138 as a press member has an inter elastic layer (elastic layer) 141 and an outer elastic layer (elastic layer) 140 around a conductive core 150. An outermost layer of the press roller 138 is a releasing layer (surface resistance layer) 151.

The inter elastic layer 141 is made of a silicone rubber and provided around the core 150. The outer elastic layer 140 is made of a silicone rubber and provided around the inter elastic layer 141. Note that the outer elastic layer 140 is thinner and the silicone rubber thereof is slightly more conductive than the inner elastic layer 141.

The releasing layer 151 is an adiabatic PFA tube (volume resistivity $10^{15}$ Ω·cm or more) formed around the outer elastic layer 140.

Note that a primer layer may be provided as an intermediate layer between the inter elastic layer 141 and the outer elastic layer 140, in order to attain higher bonding between the silicone rubbers. Moreover, an intermediate layer may be provided respectively between the releasing layer 151 and the outer elastic layer 140, and between the inter elastic layer 141 and the core 150. Note that in this case the press roller 138 has heat transmission coefficient K1 as follows:

$K1$=1/(heat resistance of core 150+heat resistance of inter elastic layer 141+heat resistance of outer elastic layer 140+heat resistance of releasing layer 151+heat resistances of respective intermediate layers) Equation 5.

Note that the heat resistance of the intermediate layer may be omitted if there is no intermediate layer is provided or if it is extremely thin.

In the above arrangement, heat transmission coefficient K2 of the fix belt 131 is 12352 $W/m^2 \cdot K$, whereas the heat transmission coefficient K2 of the press roller 138 is 37.3 $W/m^2 \cdot K$. Here, a ratio between K1 and K2 is 1:131.

In this arrangement, the press roller 138, which requires a high adiabatic performance, is so arranged that the outer elastic layer 140 has a relatively higher heat conductivity than the inter elastic layer 141, in order to give the outer elastic layer 140 a relatively faster heating rate. In this way, heat property of the fix belt 131, which is so extremely thin, can be compensated for. As such, the adiabatic performance and the elastic performance of the press roller 138 is mainly contributed by the inter elastic layer 141 that is relatively lower in heat conductivity than the outer elastic layer 140. Therefore, a surface of the press roller 138 becomes easy to warm up meanwhile an inside thereof has such high adiabatic performance. With this arrangement, the press roller 138 as a whole is given a low heat transmission coefficient. Moreover, by giving the faster heating rate to the outer elastic layer 140, faster printing becomes possible. Thus, it becomes possible to compensate for insufficient heat capacity of the fix belt 131. The insufficient heat capacity of the fix belt 131 is one of causes for reduction in fixing performance during sequential fixing process.

Moreover, in the present embodiment, the heating roller for heating the surface of the press roller 138 is not tangent to the press roller 138. However, for faster printing speed, or under adverse environmental conditions, a heating roller for heating only outer circumference of the press roller 138 may be provided. With this arrangement, it is possible to attain further shorter warming-up time and better fixing performance.

In the present embodiment, the base belt 132 is made of Ni. However, the base belt 132 may be a belt made of stainless steel (0.1 mm or 0.2 mm in thickness). Further, the base belt 132 may be a belt made of a heat resisting resin such as polyimide, polyamide, or the like. Furthermore, the base belt 132 may be a belt made of more elastic silicone rubber or fluoride rubber. Especially, the belts made of resin or rubber show high adiabatic effect against heat externally applied, as well as against the heat applied internally. Thus, by arranging such that the belt has high adiabatic property to thermally insulate its inside from the heat externally applied, only the surface of the belt is heated thereby attaining efficient heating of the recording medium 91. Thus, it is possible to efficiently melt and fix the toner 93.

As an improved modification of the present embodiment, the present embodiment may be applied to a transferring/fixing device for use in a method in which the transferring and the fixing are carried out concurrently. Specifically, the fix belt 131 of the present embodiment has high heat transmission coefficient. Thus, pin-point heating can be performed on the fix belt 131 of the present embodiment by locally heating the fix belt 131. Further, the heat is transmitted quickly. Therefore, by using the fix belt 131 of the present embodiment in the transferring/fixing device, the high heat transmission coefficient allows that the heating is carried out just before the fixing and cooling is carried out quickly after the fixing. Thus, the transferring can be performed in the absence of influence of the heat applied on the belt 131 during the fixing.

The present invention is not limited to the size, material, heating method, control method or the like described in the present embodiment as above. For example, the present invention may adopt a heating method in which a ceramic heater capable of locally heating touches an inside surface of the belt, or a heating method in which heating means of induction heating is provided to heat the fix belt from an outer surface or inner surface of the fix belt. Moreover, in terms of the multi-layer structure of the press roller, the present embodiment is so arranged that each layer is identical in terms of thickness over the whole axial direction of the roller. However, it is needless to say that the press roller may have such outer elastic layer and/or inner elastic layer whose layer thickness different at a middle portion and edge portion of the roller, depending on shape of nip portion between the press roller and fix roller, and on the heating performance.

[Fourth Embodiment]

Yet another embodiment of the present invention is described below. Note that the explanation on the members identical to the corresponding member in the first embodiment is omitted here.

Figure 19:
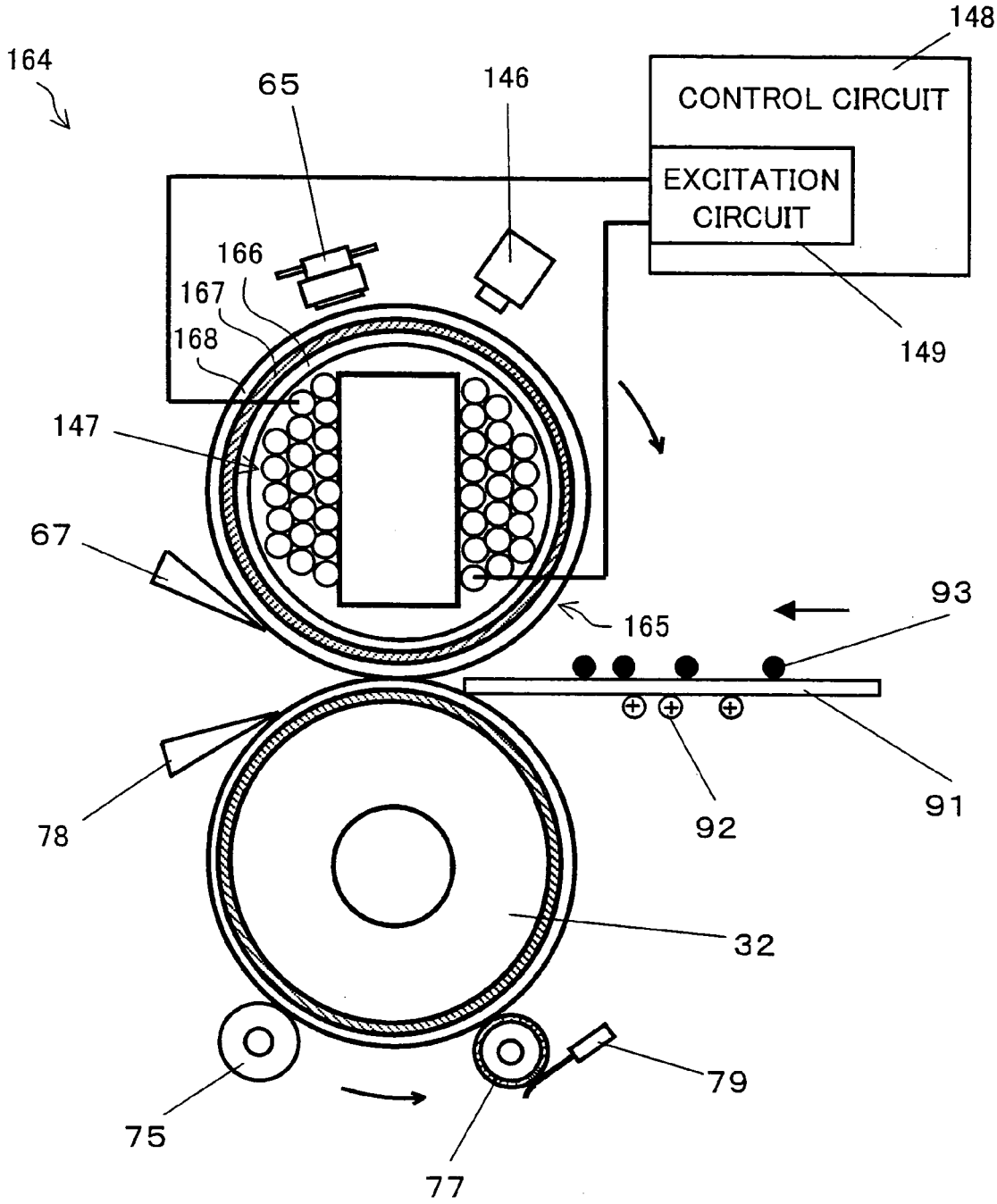
FIG. 19 is a vertical cross sectional view illustrating a fixing device of an embodiment different from the still another embodiment shown in FIG. 18.

In a fixing device 164 according to the present embodiment, as shown in FIG. 19, the induction heating method is adopted as the heating method of heating a fix roller 165. Specifically, the fix roller 165 is internally provided with a heating coil (magnetic field generating means) 147 as heating means, in order to heat the fix roller 165.

The fix roller 165 is provided with a core 166 made of magnetic stainless steel (SUS 403). The core 166 is 0.2 mm in thickness (wall thickness). On a surface of the core 166, a primer layer 167 as an intermediate layer is provided. Further, on a surface of the primer layer 167, an electric insulating releasing layer 168 made of a PFA tube (file thickness: 50 μm) is provided. Moreover, the fix roller 165 is in a straight shape having a diameter of 35 mm. As such, respective ends of the fix roller 165 is not narrowed.

The heating coil 147 may be made of, for example, an aluminum single wire, a copper wire, or a copper-based compound wire, taking heat resistance into consideration. Further, heating coil 147 may be made of, for example, a litz wire (stranded wire made of enamel wire or the like). In any case, it is preferable that overall resistance of the heating coil 147 is 0.5Ω or less, in order to cause the coil 147 to have small Joule heat. Even though only one heating coil 147 is provided in the present embodiment, it may be arranged that a plurality of the heating coils 147 are provided along a circumferential direction or axial direction so that they respectively heat divided heating regions or partially overlapped heating regions.

In the present embodiment, the induction heating method is adopted, which has high heating efficiency and excellent heating performance. Therefore, it is preferable to adopt non-contact temperature detection method for monitoring temperature of the fix roller 165. In the non-contact temperature detection method, a thermopile or other resistance element that has high detection speed is used. Because of this, in the present embodiment, a first temperature detector 146*a* and a second temperature detector 146*b* are provided around the fix roller 165. The first and second temperature detectors 146*a* and 146*b* are not in contact with the fix roller 165.

The first temperature detector 146*a* is used to detect temperature of an axial middle portion of the fix roller 165. Moreover, the second temperature detector 146*b* is used to detect temperature in a portion of that axial edge of the fix roller 165 which is far from a driving system.

Moreover, in the present embodiment, a heating roller 77 is provided in addition to the press roller 32 as in the present embodiment. The heating holler, which is tangent to the press roller 32, heats up a surface of the press roller 32. In this way, the circumferential surface of the press roller 32 is thermally compensated for.

The heating roller 77 is internally provided with a halogen lamp as heating means for heating the heating roller 77. Moreover, as temperature detection means for measuring temperature of the press roller 32, a thermistor 79 of contact type and high-speed responding type is provided.

As illustrated in FIG. 19, the heating coil 147 is driven by an excitation circuit 149 that consists of an inverter. Specifically, a control circuit 148 detects the temperature of the heating coil 147, and outputs a control signal according to parameters such as the detected temperature, and size and material of recording medium 91. The control signal indicates operation conditions. Then, the excitation circuit 149 performs most suitable excitation of the heating coil 147 according to the control signal.

The press roller 32 is basically identical with that in the first embodiment, except that the press roller 32 here is 35 mm in external diameter.

Here, a core 166 of the fix roller 165 is made of stainless. The core 166 made of stainless gives adverse effect on heating performance compared with the cores made of the iron-based material or the aluminum alloy. However, the use of the induction heating method in the fix roller 165 provides maximum improvement in the heating efficiency than the use of the halogen lamp as the heating means, and compensates for the adverse effect given by the use of stainless as the material of the core 166. With this arrangement, this allows the fix roller 165 to maintain its high heat transmission coefficient even though the core 166 is made of stainless. Specifically, the fix roller 165 has heat transmission coefficient K2 of 4838 $W/m^2 \cdot K$ in the present embodiment.

On the other hand, the press roller 32 of the present embodiment has a heat transmission coefficient K1 of 33.7 $W/m^2 \cdot K$, similarly to the press roller 32 of the first embodiment. Therefore, in the present embodiment, a ratio between the heat transmission coefficient K1 of the press roller 32 and the heat transmission coefficient K2 of the fix roller 165 is 1:143.6. This ratio falls within the range that allows practical use.

Moreover, a ratio (diameter/thickness) between diameter and thickness (wall thickness) of the core 166 of the fix roller 165 is 175. A ratio between diameter and thickness of an elastic layer 72 of the press roller 32 is 7. A ratio between diameter and thickness (wall thickness) of a core 71 of the press roller 32 is 8.3. These values are within the ranges in which the heating and adiabatic performance, and structure, of the rollers are ensured with no problem.

Moreover, when power of 1200 W is applied to the fixing device 164, warming-up time of 30 seconds or more is obtained, even though it is subjected to the heating efficiency.

Especially, in the induction heating method in which the local heating is performed, uneven temperature distribution on the rollers is easy to occur during waiting time (warming-up time). Such uneven temperature distribution would possibly cause thermal deformation of the rollers. However, in the present embodiment, the fix roller 165 has better rapid heating performance than the conventional art, while the press roller 32 also has better rapid heating performance than the conventional art. Therefore, by directly heating the circumferential surface of the press roller 32 by the heating roller 77, it is possible to perform the heating of the fix roller after promptly achieving even temperature distribution on the rollers in earliness of rotation of the rollers.

The present invention is not limited to the size, material, heating method, control method and the like described in the present embodiment as above. For example, the present invention may adopt resistance heating method as the heating method. In this case, it is needless to say that the present invention can be realized by having the heat transmission coefficient, taking a resistance heating layer and an electric insulating layer into consideration. Moreover, the present invention may be realized with an arrangement in which no heating roller 77 is used.

In the following the fixing devices described in the first to fourth embodiments are explained. The heat transmission coefficient of the press member indicates the adiabatic performance as to how easy the heat flux reach the inside of the press member from the surface of the press member, the heat flux introduced from the surface of the press member. On the other hand, the heat transmission coefficient of the fix member indicates the heating performance as to how easy the heat flux travel from the inside of the fix member to the surface of the fix member, the heat flux supplied by the heating means. These coefficients are defined by a reciprocal number of heat resistance (thickness of material/heat conductivity of material).

When the relationship between the coefficients of the fix member and press member is K1<K2 where K1 is the coefficient of the press member and K2 is the coefficient of the fix member, it is possible to attain such adiabatic performance of the press member and heating performance of fix member that allow efficient utilization of the heat flux supplied for the heating of the fix member. By such efficient utilization of the heat flux, waste of heat flux is minimized and the heating is performed more efficiently.

Moreover, in the relationship of K1<K2, it is preferable that K1 is sufficiently small whereas K2 is sufficiently large. Under such circumstances, the heating of the fix member can be performed with a small amount of power. Further, because of the high adiabatic performance of the press member, the movement of the heat to the press member is prevented, thereby attaining prompt heating of the fix member.

The adiabatic and heating properties of the fixing device can be evaluated by the heating performance and adiabatic performance of the fix member and the press member. If a ratio between the heat transmission coefficient K1 of the press member and the heat transmission coefficient K2 of the fix member is in a range of 1:100 to 1:320, preferably in a range of 1:100 to 1:300, it is possible to efficiently utilize the heat to increase the temperature of the fixing device, the heat supplied to the surface of the fix member by heating the fix member. The larger ratio indicates that the heating performance of the fix member and the adiabatic performance of the press member are higher.

Further, the fix member that is difficult to heat can have a higher heating responsibility by reducing its coefficient K2. On the other hand, the fix member that is difficult to heat would have poor heating responsibility when its coefficient K2 is large, and could not contribute to shorter warming-up time.

Moreover, in order to cause the press member to have capability of forming a wide nip portion when pressed against the fix member, and a sufficient adiabatic performance, the press member is provided with the elastic layer excellent in adiabatic performance. Here, it is assumed that the press member is provided with a core, an elastic layer, and a releasing layer, the core having a thickness (wall thickness) t13 and a heat conductivity λ13, the elastic layer having a thickness (layer thickness) t12 and a heat conductivity λ12 and being provided outside of the core, and the releasing layer having a thickness (film thickness) t11, and a heat conductivity λ11, being provided outside of the elastic layer and high in releasing effect so as to prevent the toner from fusing on the press member. The heat transmission coefficient K1 indicates how easily the heat flux passes through the press member of this arrangement. The heat transmission coefficient K1 is defined by:

$$K1=1/(t11/\lambda 11+t12/\lambda 12+t13/\lambda 13) \quad \text{Equation 11.}$$

K1 is a reciprocal number of the sum of resistances against heat transmission ($m^2 \cdot K/W$), which indicate how difficult the heat transmission is in the respective layers. Moreover, in case where intermediate layers such as primer layers or the like are provided respectively between the releasing layer and the elastic layer, and between the elastic layer and the core, the heat conductivities of the first and second intermediate layers are respectively λ16 and λ17, whereas the thickness (film thickness) of the first and second intermediate layers are respectively t16 and t17. Considering the two intermediate layers, Equation 11 is rewritten as follows:

$$K1=1/(t11/\lambda 11+t16/\lambda 16+t12/\lambda 12+t13/\lambda 13+t17/\lambda 17) \quad \text{Equation 12.}$$

Note that these intermediate layers are very thin compared with the releasing layer, elastic layer and the core. Therefore, in many cases, Equation 11 can be used instead of Equation 12 even if the intermediate layers are provided.

The smaller coefficient K1 of the press member indicates that the press member has higher adiabatic performance and thus has such a property that the heat transmission from the surface of the press member to the inside of the press member is difficult. However, the larger coefficient K1 of the press member indicates that the heat transmission from the surface of the press member to the inside of the press member is easy. As a result of the easy heat transmission, the heat on the surface of the press member is transmitted into the inside of the press member and stored therein, even though the heat is supposed to contribute to the heating and fixing.

Therefore, it is so arranged that the heat transmission coefficient K1 of the press member is not less than 15 $W/m^2 \cdot K$ but not more than 150 $W/m^2 \cdot K$. It is preferable that the heat transmission coefficient K1 of the press member be not less than 20 $W/m^2 \cdot K$ but not more than 100 $W/m^2 \cdot K$. When the heat transmission coefficient K1 is within these ranges, the adiabatic performance of the press member is maintained but the heating performance of the fix member is hardly affected adversely. This leads to the shorter warming-up time of the fixing apparatus. Moreover, it is possible to attain lower power consumption during the warming-up and the transportation (sheet transportation) of the recording medium. Further, there is no need of using an elastic layer made of a material, such as sponge, whose air hole is easy to break and which likely causes sag. The press roller can attain and keep its adiabatic performance for a long time.

Moreover, in order to cause the fix member to have capability of forming a wide nip portion when pressed against the press member, and a sufficient heating performance, the fix member needs a sufficient strength to hold the pressing force against the press member, and capability of efficiently transmitting the heat from the heating means provided inside the fix member to the surface of the fix member. Depending on how strong the fix member is to hold the force and how efficiently the fix member can transmit the heat, the warming-up time of the fixing device is largely affected.

Here, it is assumed that the fix member is provided with a core and a releasing layer, the core having a heat conductivity λ15 and a thickness (wall thickness) t15, and the releasing layer having a heat conductivity λ14 and a thickness (wall thickness) t14 and being provided outside of the core and high in releasing effect so as to prevent the toner from fusing on the fix member. The heat transmission coefficient K2 indicates how easily the heat flux passes through the fix member of this arrangement. The heat transmission coefficient K2 is defined by:

$$K2=1/(t14/\lambda 14+t15/\lambda 15) \quad \text{Equation 11.}$$

K2 is a reciprocal number of the sum of resistances against heat transmission ($m^2 \cdot K/W$), which indicate how difficult the heat transmission is in the respective layers. Moreover, in case where an intermediate layer such as a primer layer or the like is provided between the releasing layer and the core, the heat conductivity of the intermediate layer is λ18, whereas the thickness (film thickness) of the intermediate layer is t18. Considering the intermediate layer, Equation 13 is rewritten as follows:

$$K2=1/(t14/\lambda 14+t18/\lambda 18+t15/\lambda 15) \quad \text{Equation 14.}$$

Note that the intermediate layer is very thin compared with the releasing layer and the core. Therefore, in many cases, Equation 13 can be used instead of Equation 14 even if the intermediate layer is provided.

The larger coefficient K2 of the fix member indicates that the fix member has higher heating performance and thus has such a property that the heat transmission from the inside of the fix member to the surface of the fix member is easy. On the other hand, the smaller coefficient K2 of the fix member indicates that the fix member has such a property that the heat transmission from the inside of the fix member to the surface of the fix member is difficult, and it is not easy to heat the fix member up even by using a large power (thereby failing to attain a short warming-up time). Therefore, the heat transmission to the surface takes time: the heat is stored inside the core in a long time and thus it takes a long time for the heat to reach the surface.

Therefore, it is so arranged that the heat transmission coefficient K2 of the fix member is not less than 4000 $W/m^2 \cdot K$ but not more than 6400 $W/m^2 \cdot K$. It is preferable that the heat transmission coefficient K2 of the fix member be not less than 4300 $W/m^2 \cdot K$ but not more than 6300 $W/m^2 \cdot K$. When the heat transmission coefficient K2 is within these ranges, the fix member has high heating performance so that it can be heated up quickly. Synergic effect of the high heating performance of the fix member and the high adiabatic performance of the press member shortens the warming-up time of the fixing device.

Moreover, it is possible to reduce the power consumption during the warming-up and during the transportation of the recording medium. Further, even if no power is supplied to the heating means during a long waiting time in which no heating is necessary, the fixing device can get ready for printing, photocopying, or the like so promptly that the convenience for the user will be ensured.

Moreover, as described above, the adiabatic and heating properties of the fixing device can be evaluated by the heating performance and adiabatic performance of the fix member and the press member. If a ratio between the heat transmission coefficient K1 of the press member and the heat transmission coefficient K2 of the fix member is in a range of 1:100 to 1:320, preferably in a range of 1:100 to 1:300, it is possible to efficiently utilize the heat to increase the temperature of the fixing device, the heat supplied to the surface of the fix member by heating the fix member.

In order to prepare the highly adiabatic press member having the coefficient of the overall heat transmission within the range, the elastic layer thereof is prepared by mixing and kneading the filler of low heat capacity in the base material in the predetermined ratio (volumetric ratio), and then by carrying out vulcanization of thus prepared mixture of the base material and the filler, and the like. The volumetric ratio of the filler of low heat capacity is within the predetermined range. In order to keep the volumetric ratio within the range, it is preferable that the filler of low heat capacity be 200 μm or less in particle diameter.

If the particle diameter of the filler was too large, the filler could not be dispersed evenly in the mixing and kneading. Further, for the filler of such large particle diameter, the volumetric ratio should be high. These cause the elastic material (such as silicone rubber or the like) as the base material to have low elastic property. As a result, the elastic layer would have high hardness and low compression deformation ratio. Thus, the elastic layer would have a small elastic region (that is, the elastic layer would be insufficiently elastic so that a force applied thereon would dent only a small area of the elastic layer. Therefore, with such elastic layer, the press member cannot form a sufficient nip section with the fix member. Thus, the fixing performance would not be sufficient. In some cases, the elastic layer would almost entirely lose its elastic property due to deterioration with age. Therefore, in order to have low heat transmission coefficient and maintain the elastic property, it is necessary to use the filler of low heat capacity and of 200 μm or less in particle diameter. It is more preferable that the particle diameter of the filler be 100 μm or less. It is preferable that the diameters of particles of the filler be even, that is, standard deviation of the diameters of the particles of the filler be small.

Moreover, the ratio between the diameter and layer thickness of the elastic layer of the press member, and the ratio between the diameter and wall thickness of the core of the press member indicate how influential the deformation of the press member is on the layer thickness, that is, the heat transmission coefficient. This is, these ratios indicate balance between (a) easiness in deformation and (b) the adiabatic performance. If the ratios were too large, deformation would be easy and the coefficient would be large. Thus, not only the adiabatic performance but the shape of the press member could not be maintained. If the ratios were too small, the coefficient would be small and the adiabatic performance would be high. In this case, the shape could maintained, but the large thickness would result in high heat capacity, thus making it impossible to keep the fixing performance. Moreover, too large thickness would not be so effective in shortening the warming-up time.

Moreover, the ratio of the diameter and wall thickness of the core of the fix member indicates balance between the heating performance and difficulty in deformation. If the ratio was too large, the wall thickness would be too thin or the diameter would be too large. Thus, even though the coefficient is small, it would become impossible to maintain the shape of the fix member. If the ratio was too small, the heat capacity of the fix member would become high and the coefficient would be large. Thus, the heating performance of the fix member would be deteriorated.

Furthermore, adiabatic properties of elastic layers of different materials cannot be compared simply by comparing the instinct heat conductivities and thermal diffusivities of the materials as performed in the conventional art. This is because those instinct values lack the geometric parameters therein. In the practical use, the comparison between the adiabatic properties of elastic layers of different materials can be performed easily by comparing thickness of the elastic layers to have a specific the adiabatic performance.

As the standard adiabatic material, glass wool (heat conductivity: 0.05 $W/m^2 \cdot K$; thickness 100 mm), which is an adiabatic material generally used, is adopted. Compared is the thickness (equivalent thickness) to allow the elastic layers to have the adiabatic performance equivalent with that of the glass wool in the thickness of 100 mm. An elastic material having a larger equivalent thickness is lower in the adiabatic performance, whereas an elastic material having a larger equivalent thickness is lower in the adiabatic performance.

The material having the equivalent thickness of 100 mm or more (equivalent to the glass wool) but 500 mm or less gives the press roller the high adiabatic performance but would not give large heat capacity. Thus, it is possible to attain a shorter warming-up time, without deteriorating the heating performance of the fix roller. Further, it is possible to attain lower power consumption.

The application of the fixing devices according to the first to fourth embodiments allows stable operation. That is, in a long-time usage of an image forming device, it is possible to avoid temporally putting the image forming device in an unusable state due to an end of the life of the fixing device. No frequent maintenance is necessary. Further, cost for those can be reduced. Especially, if lives of the fix member and the press member are shorter than predetermined, it leads to higher running cost and it likely that cost for replacing the fix member and press member becomes comparatively higher.

Moreover, if the warming-up time can be shortened as in the fixing device according to the first to fourth embodiments, (a) it is allowed to arrange such that, during a period in which the fixing device is not used, the heating means is kept at a relatively lower temperature or no power is stopped to the heating means, but (a) when the fixing device is about to be used it is possible to promptly get the fixing device ready in a short waiting time, thus making the image forming device user-friendly for better convenience.

That is, even under high-speed and high load conditions, the fixing devices according to the first to fourth embodiments can maintain their adiabatic capabilities, thereby attaining shorter warming-up time and longer lives of the respective members. Moreover, the fixing devices according to the first to fourth embodiments, which can maintain their adiabatic capabilities for a long period, can attain lower power consumption during a series of operations and conditions of the image forming device: from the warming-up, sheet transportation to waiting time. Thus, it is possible to perform the fixing operation with lower power consumption.

Note that the fixing devices according to the first to fourth embodiments are applicable to an electrophotographic fixing device, a drier device, an eraser device, and a printing device. In this case, a recording medium, on which an unfixed image or a printed image with toner or the like is held, is transported through a nip between a fix member and a press member, which are respectively in a roller-like form or a belt-like form, and fixing operation or the like of the image onto the recording medium is carried out by melting and drying, which are done by heat application.

In order to attain the object, a fixing device according to the present invention includes a fix member for touching an unfixed image on a recording medium, and a press member for being pressed against the fixing member, so as to fix the unfixed image on the recording medium by transporting the recording medium through a nip between the fix member and the press member, wherein:

$$(100\cdot K1)\leqq(K2)\leqq(320\cdot K1)$$

where K1 is a heat transmission coefficient of the press member and K2 is a heat transmission coefficient of the fix member.

The "heat transmission coefficient" of a material is a parameter that indicates how easily heat flux passes through the material. The larger this parameter, the more easily the heat flux passes through the material. Specifically, the heat transmission coefficient of a material is a reciprocal number of heat transmission resistance of the material. Moreover, the heat transmission resistance of a material can be calculated by (thickness of the material/heat conductivity of the material).

As a result of diligent studies, the inventors of the present invention found out that it is easy to transmit heat to the fix member but it is difficult to transmit, to the press member, the heat thus transmitted to the fix member, thereby efficiently utilizing, for fixing operation, the heat transmitted to the fix member, where in the fixing device the heat transmission coefficient K1 of the press member and the heat transmission coefficient K2 of the fix member satisfy $(100\cdot K1)\leqq(K2)\leqq(320\cdot K1)$. With this arrangement, it is possible to transmit the heat from the fixing device to the toner and the recording medium in a short time, thereby realizing the high-speed printing.

In addition to the above arrangement, a fixing device according to the present invention may be arranged such that the press member includes at least a core, an elastic layer provided on/above an outer surface of the core, and a releasing layer on/above an outer surface of the elastic layer; the heat transmission coefficient K1 is defined by:

$$K1=1/\{(t1/\lambda1)+(t2/\lambda2)+(t3/\lambda3)\},$$

where t1 is a thickness of the releasing layer, λ1 is a heat conductivity of the releasing layer, t2 is a thickness of the core, λ2 is a heat conductivity of the core, t3 is a thickness of the elastic layer, and λ3 is a heat conductivity of the elastic layer; and the heat transmission coefficient K1 is not less than 15 $W/m^2\cdot K$ but not more than 150 $W/m^2\cdot K$.

The heat transmission coefficient of the press member is equal to the reciprocal number of the sum of the thermal resistances of the respective layers of which the press member consists. Therefore, the heat transmission coefficient of the press member provided with the releasing layer, elastic layer, and core is defined by $K1=1/\{(t1/\lambda1)+(t2/\lambda2)+(t3/\lambda3)\}$.

The smaller heat transmission coefficient K1 of the press member indicates that the press member has a higher adiabatic performance and thus is more difficult to transmit the heat from the surface thereof to the inside thereof. Moreover, the larger heat transmission coefficient K1 allows the heat to pass through the press member more easily, whereby it becomes easier for the heat to escape from the fix member to the press member.

As a result of diligent studies, the inventors of the present invention found out that, if the heat transmission coefficient K1 of the press member is 15 $W/m^2\cdot K$ or more but 150 $W/m^2\cdot K$, it is possible to shorten the warming-up time of the fixing device without deteriorating the adiabatic performance of the press member. With this arrangement, it is also possible to attain lower power consumption during the warming-up, and the transportation of the recording medium.

In addition to the above arrangement, a fixing device according to the present invention may be arranged such that the fixing member includes at least a core, and a releasing layer on/above an outer surface of the core; the heat transmission coefficient K2 is defined by:

$$K2=1/\{(t4/\lambda4)+(t5/\lambda5)\},$$

where t4 is a thickness of the core, λ4 is a heat conductivity of the core, t5 is a thickness of the releasing layer, and λ5 is a heat conductivity of the releasing layer; and the heat transmission coefficient K2 is not less than 4000 $W/m^2\cdot K$ but not more than 6400 $W/m^2\cdot K$.

The heat transmission coefficient of the fix member is equal to the reciprocal number of the sum of the thermal resistances of the respective layers of which the fix member consists. Thus, the heat transmission coefficient K2 of the press member provided with the releasing layer and the core is defined by $K2=1/\{(t4/\lambda4)+(t5/\lambda5)\}$.

The larger heat transmission coefficient K2 indicates that the fix member has a higher heating performance and thus is easier to transmit the heat from the inside thereof to the surface thereof. Moreover, the smaller heat transmission coefficient K2 indicates that it is more difficult to heat up the fix member. Thus, even if a large amount of power is applied in order to cause the heat to diffuse the heat over the fix member, it is impossible to avoid a long warming-up time.

As the result of diligent studies, the inventors of the present invention found out that if the heat transmission efficient K2 of the fix member is not less than 4000 $W/m^2\cdot K$ but not more than 6400 $W/m^2\cdot K$, the fix member has a high heating performance and can be heated up promptly. With this arrangement, it is possible to attain the warming-up time, and lower power consumption during the warming-up time and the transportation of the recording medium. Further, even if no power is supplied during a long waiting time in which no heating is necessary, it is possible to get ready for printing in a short time without deteriorating the convenience for the user.

In addition to the above arrangement, a fixing device according to the present invention may be arranged such that the elastic layer of the press member includes a base rubber and a filler having a lower heat conductivity than the base rubber.

As a result of diligent studies, the inventors of the present invention found out that, if the elastic layer of the press roller is made of a material that is a mixture of the base rubber and the filler having a lower heat conductivity than the base rubber, it is possible to attain the heat transmission coefficient of the press member not less than 15 $W/m^2\cdot K$ but not more than 150 $W/m^2\cdot K$. With this arrangement, even if no silicone sponge is used as the base material of the press member, it is possible to realize a fixing device capable of performing high-speed printing. Thus, it is possible to give the device a longer life than the conventional one.

In addition to the above arrangement, a fixing device according to the present invention may be arranged such that the filler has a particle diameter of 200 μm or less. If, in the elastic layer, the volumetric ratio of filler to the volume of the elastic material is too high, the filler is dispersed unevenly in the base rubber. This results in lower elastic property of the base rubber that is to be the base material. Thus, the resultant elastic layer has too high hardness. As a result, it becomes difficult to form a nip between the fix member and the press member. Therefore, it is necessary to have an appropriate volumetric ratio of the filler to the elastic material.

As a result of diligent studies, the inventors of the present inventions found out that, the filler may be spherical, elliptical, planiform, or non-spherical, and can contribute to restraining the adiabatic performance of the press roller without deteriorating the elastic performance of the elastic layer, if the particle diameter of the filler is 200 μm or less.

In addition to the above arrangement, a fixing device according to the present invention may be arranged such that a ratio between a diameter and a thickness of the elastic layer is not less than 3 but not more than 20.

Moreover, In addition to the above arrangement, a fixing device according to the present invention may be arranged such that a ratio between a diameter and a thickness of the core is not less than 6 but not more than 11.

If the ratio of the diameter and thickness of the elastic layer or that of the core is too large, the press member is easy to deform, and it is impossible to keep the adiabatic performance of the press member. Moreover, if the ratio of the diameter and the thickness of the elastic layer or that of the core is too small, the thickness and heat capacity of the elastic layer are too large. Thus, it becomes impossible to maintain the fixing performance. Moreover, it leads to longer warming-up time.

As a result of diligent studies, the inventors of the present invention found out that, for maximally refraining such problems, it is preferable that the ratio between the diameter and the thickness of the elastic layer be not less than 3 but not more than 20, and that the ratio between the diameter and the thickness of the core is not less than 6 but not more than 11.

In addition to the above arrangement, a fixing device according to the present invention may be arranged such that a ratio between a diameter and a thickness of the core is not less than 16 but not more than 20.

If the ratio regarding the fix member is too large, it causes such a problem that the fix member cannot sustain its roller-like shape. Moreover, if the ratio regarding the fix member is too small, the fix member has high heat capacity and high heat transmission coefficient. Thus, the heating performance of the fix member is deteriorated.

As a result of diligent studies, the inventors of the present invention found out that, for maximally refraining such problems, it is preferable that the ratio between the diameter and the thickness of the core be not less than 16 but not more than 20.

In addition to the above arrangement, a fixing device according to the present invention may be arranged such that a thickness that gives the elastic layer of the press member a heat transmission coefficient equivalent to that of glass wool having a thickness of 100 mm is not less than 100 mm but not more than 500 mm (the elastic layer of the press member is made of a material that has an equivalent thickness not less than 100 mm but not more than 500 mm). To compare the conventionally available materials in terms of their adiabatic properties when processed into the elastic layer of the press member, it is not sufficient to compare them simply in terms of their instinct heat conductivity and thermal diffusivity. Moreover, it is not possible to efficiently increase the adiabatic performance of the elastic layer of the press roller by simply selecting the material having high adiabatic performance. In this arrangement, the material to be used as the material of the elastic layer is compared with the gloss wool that is an adiabatic material generally used. In the comparison, the thickness of the material is taken into consideration. With this arrangement, it is possible to easily select a material having high adiabatic performance.

In addition to the above arrangement, a fixing device according to the present invention may arranged such that the fix member is a fix belt made of nickel. Moreover, in addition to the above arrangement, a fixing device according to the present invention may arranged such that the fix member includes a heating coil for heating in induction heating method.

In addition to the above arrangement, a fixing device according to the present invention may be arranged such that the core of the fix member is made of an iron-based material.

In general, aluminum-based materials are used as the material of the core of the fix member. However, the iron-based material, which is low in heat conductivity but high in tensile strength and young's modulus, can be processed to have a thin thickness due to its high tensile strength and young's modulus. The use of such iron-based material for the core of the fix member improves the heating efficiency of the fix member.

Moreover, an image forming device according to the present invention is provided with any one of the fixing devices, in order to attain the aforementioned object.

By applying anyone of the fixing device to the image forming device, the warming-up time can be shortened as in the fixing device according to the first to fourth embodiments. Thus, (a) it is allowed to arrange such that, during a period in which the fixing device is not used, the heating means is kept at a relatively lower temperature or no power is stopped to the heating means, but (a) when the fixing device is about to be used it is possible to promptly get the fixing device ready in a short waiting time, thus making the image forming device user-friendly for better convenience.

That is, even under high-speed and high load conditions, the fixing devices according to the first to fourth embodiments can maintain their adiabatic capabilities, thereby attaining shorter warming-up time and longer lives of the respective members. Moreover, the fixing devices according to the first to fourth embodiments, which can maintain their adiabatic capabilities for a long period, can attain lower power consumption during a series of operations and conditions of the image forming device: from the warming-up, sheet transportation to waiting time. Thus, it is possible to perform the fixing operation with lower power consumption.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A fixing device comprising a fix member for touching an unfixed image on a recording medium, and a press member for being pressed against the fixing member, so as to fix the unfixed image on the recording medium by transporting the recording medium through a nip between the fix member and the press member, wherein:

$$(100 \cdot K1) \leqq (K2) \leqq (320 \cdot K1)$$

where K1 is a heat transmission coefficient of the press member and K2 is a heat transmission coefficient of the fix member.

2. A fixing device as set forth in claim 1, wherein:
the press member includes at least a core, an elastic layer provided on/above an outer surface of the core, and a releasing layer on/above an outer surface of the elastic layer.

3. A fixing device as set forth in claim 2, wherein:
the heat transmission coefficient K1 is defined by:

$$K1 = 1/\{(t1/\lambda 1) + (t2/\lambda 2) + (t3/\lambda 3)\},$$

where t1 is a thickness of the releasing layer, λ1 is a heat conductivity of the releasing layer, t2 is a thickness of the core, λ2 is a heat conductivity of the core, t3 is a thickness of the elastic layer, and λ3 is a heat conductivity of the elastic layer.

4. A fixing device as set forth in claim 2, comprising:
an intermediate layer, between the elastic layer and the releasing layer, for bonding the elastic layer and the releasing layer together,
the heat transmission coefficient K1 being defined by:

$$K1 = 1/\{(t1/\lambda 1) + (t2/\lambda 2) + (t3/\lambda 3) + (t7/\lambda 7)\},$$

where t1 is a thickness of the releasing layer, λ1 is a heat conductivity of the releasing layer, t2 is a thickness of the core, λ2 is a heat conductivity of the core, t3 is a thickness of the elastic layer, λ3 is a heat conductivity of the elastic layer, t7 is a thickness of the intermediate layer, and λ7 is a heat conductivity of the intermediate layer.

5. A fixing device as set forth in claim 1, wherein:
the heat transmission coefficient K1 is not less than 15 $W/m^2 \cdot K$ but not more than 150 $W/m^2 \cdot K$.

6. A fixing device as set forth in claim 2, wherein:
the elastic layer includes a base rubber and a filler having a lower heat conductivity than the base rubber.

7. A fixing device as set forth in claim 6, wherein
a ratio between the base rubber and the filler is 100:18 by mass.

8. A fixing device as set forth in claim 6, wherein:
the filler has a particle diameter of 200 μm or less.

9. A fixing device as set forth in claim 6, wherein:
the filler has a particle diameter of 20 μm or more.

10. A fixing device as set forth in claim 1, wherein:
the fixing member includes at least a core, and a releasing layer on/above an outer surface of the core.

11. A fixing device as set forth in claim 10, wherein:
the heat transmission coefficient K2 is defined by:

$$K2 = 1/\{(t4/\lambda 4) + (t5/\lambda 5)\},$$

where t4 is a thickness of the core, λ4 is a heat conductivity of the core, t5 is a thickness of the releasing layer, and λ5 is a heat conductivity of the releasing layer.

12. A fixing device as set forth in claim 10, comprising:
an intermediate layer, between the core and the releasing layer, for bonding the core and the releasing layer together,
the heat transmission coefficient K2 being defined by:

$$K2 = 1/\{(t4/\lambda 4) + (t5/\lambda 5) + (t6/\lambda 6)\},$$

where t4 is a thickness of the core, λ4 is a heat conductivity of the core, t5 is a thickness of the releasing layer, λ5 is a heat conductivity of the releasing layer, t6 is a thickness of the intermediate layer, and λ6 is a heat conductivity of the intermediate layer.

13. A fixing device as set forth in claim 1, wherein:
the heat transmission coefficient K2 is not less than 4000 $W/m^2 \cdot K$ but not more than 6400 $W/m^2 \cdot K$.

14. A fixing device as set forth in claim 1, wherein:
the press member is a press roller including a core, an elastic layer on/above an outer surface of the core, and a releasing layer on/above an outer surface of the elastic layer, the core having a circular column-like shape, the elastic layer having a tube-like shape, and the releasing layer having a tube-like shape.

15. A fixing layer as set forth in claim 14, wherein:
a ratio between a diameter and a thickness of the elastic layer is not less than 3 but not more than 20.

16. A fixing layer as set forth in claim 14, wherein:
a ratio between a diameter and a thickness of the core is not less than 6 but not more than 11.

17. A fixing device as set forth in claim 1, wherein:
the fixing member is a fix roller including a core and a releasing layer on/above an outer surface of the core, the core having a tube-like shape and the releasing layer having a tube-like shape.

18. A fixing device as set forth in claim 17, wherein:
a ratio between a diameter and a thickness of the core is not less than 16 but not more than 20.

19. A fixing device as set forth in claim 2, wherein:
the elastic layer has a thickness in a range of from 100 mm to 500 mm.

20. A fixing device as set forth in claim 19, wherein:
a heat transmission coefficient of the elastic layer is equivalent to that of glass wool having a thickness of 100 mm.

21. A fixing device as set forth in claim 1, wherein:
the fix member is a fix belt made of nickel or stainless steel.

22. A fixing device as set forth in claim 1, wherein:
the fix member includes a heating coil for heating in induction heating method.

23. A fixing device as set forth in claim 1, wherein:
the core of the fix member is made of an iron-based material.

24. An image forming device comprising the fixing device as set forth in any one of claims 1 to 23.

25. A method for manufacturing a fixing device including a fix member for touching an unfixed image on a recording medium, and a press member for being pressed against the fixing member, so as to fix the unfixed image on the recording medium by transporting the recording medium through a nip between the fix member and the press member, wherein:

the press member and the fix member are prepared to satisfy:

$$(100 \cdot K1) \leqq (K2) \leqq (320 \cdot K1)$$

where K1 is a heat transmission coefficient of the press member and K2 is a heat transmission coefficient of the fix member.

* * * * *